US012364283B1

(12) United States Patent
Jurist et al.

(10) Patent No.: US 12,364,283 B1
(45) Date of Patent: Jul. 22, 2025

(54) MOUTHPIECE ASSEMBLY FOR AN ATOMIZATION DEVICE

(71) Applicant: V TECHNOLOGIES CORP., Chester, NJ (US)

(72) Inventors: Samuel Jurist, Chester, NJ (US); John Quion, Glendale, CA (US); Jianfang Li, Zhongshan (CN); Chunlan Zhu, Zhongshan (CN)

(73) Assignee: V TECHNOLOGIES CORP., Chester, NJ (US)

( * ) Notice: Subject to any disclaimer, the term of this patent is extended or adjusted under 35 U.S.C. 154(b) by 0 days.

(21) Appl. No.: 18/612,351

(22) Filed: Mar. 21, 2024

(51) Int. Cl.
*A24F 40/46* (2020.01)
*A24F 40/10* (2020.01)
*A24F 40/20* (2020.01)

(52) U.S. Cl.
CPC ..... *A24F 40/46* (2020.01); *A24F 40/10* (2020.01); *A24F 40/20* (2020.01)

(58) Field of Classification Search
CPC .... A24F 7/04; A24F 1/30; A24F 47/00; A24F 47/008; A24F 40/00; A24F 7/00; A24F 7/02; A24F 40/10; A24F 40/20; A24F 40/46; A61M 15/0021; A61M 15/0023; A61M 15/0025; A61M 15/0026; A61M 15/06
See application file for complete search history.

(56) References Cited

U.S. PATENT DOCUMENTS

| | | | |
|---|---|---|---|
| D776,867 | S | 1/2017 | Rado |
| D776,868 | S | 1/2017 | Rado |
| D779,722 | S | 2/2017 | Volodarsky |
| 9,750,284 | B2 | 9/2017 | Rado |
| 10,111,469 | B2 | 10/2018 | Zhu |
| 10,321,721 | B2 | 6/2019 | Rado |
| 10,327,470 | B2 | 6/2019 | Rado |
| D871,662 | S | 12/2019 | Volodarsky et al. |
| 10,517,334 | B1 | 12/2019 | Volodarsky et al. |
| D895,894 | S | 9/2020 | Bajpai et al. |
| D896,437 | S | 9/2020 | Volodarsky et al. |
| D944,728 | S | 3/2022 | Bajpai et al. |
| D945,058 | S | 3/2022 | Rosen et al. |
| D949,310 | S | 4/2022 | Bajpai et al. |
| 11,445,752 | B2 | 9/2022 | Liu et al. |

(Continued)

*Primary Examiner* — Philip Y Louie
*Assistant Examiner* — Yana B Krinker
(74) *Attorney, Agent, or Firm* — Woods Rogers Vandeventer Black PLC; Nathan A. Evans

(57) ABSTRACT

A mouthpiece assembly comprising an outer mouthpiece portion having an outlet portion and a plurality of inlet portions, and an inner mouthpiece portion removably engaged the outer mouthpiece portion, the inner mouthpiece portion comprises an exhaust portion having one end in communication with a body of an atomization device and another end aligned with the outlet portion, wherein the exhaust portion and the outlet portion define an exhaust passage, and a plurality of intake portions, each inlet portion of the plurality of inlet portions is aligned with each intake portion of the plurality of intake portions to form a plurality of air inlet channels, wherein each air inlet channel of the plurality of air inlet channels includes a proximal end open to an external environment and a distal end in communication with the body of the atomization device.

19 Claims, 11 Drawing Sheets

(56) References Cited

U.S. PATENT DOCUMENTS

| | | | |
|---|---|---|---|
| D978,421 | S | 2/2023 | Liu |
| D979,128 | S | 2/2023 | Liu |
| D979,129 | S | 2/2023 | Liu |
| D979,130 | S | 2/2023 | Liu |
| 11,576,431 | B1 | 2/2023 | Wiedemann et al. |
| D980,508 | S | 3/2023 | Liu |
| D980,510 | S | 3/2023 | Liu |
| D980,511 | S | 3/2023 | Liu |
| D980,512 | S | 3/2023 | Liu |
| D980,513 | S | 3/2023 | Liu |
| D980,514 | S | 3/2023 | Liu |
| D980,515 | S | 3/2023 | Liu |
| D981,033 | S | 3/2023 | Liu |
| D981,034 | S | 3/2023 | Liu |
| 11,596,173 | B2 | 3/2023 | Liu |
| 11,622,581 | B2 | 4/2023 | Rado |
| D987,176 | S | 5/2023 | Liu |
| D987,177 | S | 5/2023 | Liu |
| D987,178 | S | 5/2023 | Liu |
| 11,638,444 | B2 | 5/2023 | Liu |
| 11,653,695 | B2 | 5/2023 | Liu |
| 11,653,702 | B2 | 5/2023 | Liu |
| 11,659,865 | B2 | 5/2023 | Bajpai et al. |
| 11,659,866 | B2 | 5/2023 | Liu |
| D988,583 | S | 6/2023 | Liu |
| D988,584 | S | 6/2023 | Liu |
| D988,585 | S | 6/2023 | Liu |
| D988,586 | S | 6/2023 | Liu |
| D988,590 | S | 6/2023 | Liu |
| D989,386 | S | 6/2023 | Liu |
| 11,666,081 | B2 | 6/2023 | Liu |
| 2021/0402114 | A1* | 12/2021 | Lahoud ..... B06B 1/0269 |
| 2022/0264939 | A1* | 8/2022 | Atkin ..... A24F 9/02 |
| 2023/0211095 | A1* | 7/2023 | Aeschlimann ..... A61M 15/06 128/200.14 |

* cited by examiner

MOUTHPIECE ASSEMBLY FOR AN ATOMIZATION DEVICE

FIELD OF THE INVENTION

The present invention generally relates to the field of atomization and vaporizing devices. In particular, the present invention is directed to a mouthpiece assembly for an atomization device.

BACKGROUND

Generally, an atomization device mainly includes a vaporizer body having a mouthpiece, a body, and an atomizer disposed within the body. The atomizer includes a chamber or bowl. Various materials (e.g., organic materials) are placed within the chamber or bowl by a user to be atomized in order to generate atomized gas by heating the chamber or bowl. A user then subsequently inhales the atomized gas through the mouthpiece.

Conventional atomization devices often face challenges related to inconsistent delivery of vapor temperature, which can affect the quality of the user experience. Overheating may lead to discomfort and potential harm to the user, while underheating may result in inefficient atomization of materials and unsatisfactory atomization production. Moreover, fixed mouthpieces on many existing models hinder thorough cleaning and maintenance, potentially compromising vapor purity over time.

SUMMARY OF THE DISCLOSURE

The present invention provides an improved atomization device or vaporizer device. The present invention provides an electronic atomization device that provides an improved mouthpiece. The present invention provides an electronic cigarette device that provides an improved mouthpiece providing improved temperature of vaporized aerosols to be inhaled by a user. The present invention provides an improved electronic atomization device that provides a removable mouthpiece. The present invention provides an improved electronic atomization device that is easier to manufacture, assemble, adjust, and maintain. The present invention satisfies these needs and provides other related advantages.

In an aspect, a mouthpiece assembly configured to engage a body of an atomization device is described according to one embodiment. The mouthpiece assembly includes an outer mouthpiece portion, wherein the outer mouthpiece portion includes an outlet portion, and one or more inlet portions distributed on an outer surface of the outer mouthpiece portion. The mouthpiece assembly also includes an inner mouthpiece portion removably engaged to at least an inner side of the outer mouthpiece portion, wherein the inner mouthpiece portion includes an exhaust portion having a first end in communication with the body of the atomization device and a second end aligned with the outlet portion of the outer mouthpiece portion, and wherein the exhaust portion and the outlet portion define an exhaust passage. The inner mouthpiece portion further includes one or more intake portions distributed on an outer surface of the inner mouthpiece portion, wherein each inlet portion of the one or more inlet portions is aligned with each intake portion of the one or more intake portions to form a plurality of air inlet channels, and wherein each air inlet channel of the plurality of air inlet channels includes a proximal end open to an external environment, and a distal end in communication with the body of the vaporizer device.

In another aspect, a mouthpiece assembly configured to engage a body of an atomization device is described according to another embodiment. The mouthpiece assembly includes an outer mouthpiece portion, wherein the outer mouthpiece portion comprises an outlet portion, and a first inlet portion and a second inlet portion distributed on an outer surface of the outer mouthpiece portion in a symmetrical arrangement. The mouthpiece assembly also includes an inner mouthpiece portion removably engaged to at least an inner side of the outer mouthpiece portion, wherein the inner mouthpiece portion comprises an exhaust portion having a first end in communication with the body of the atomization device and a second end aligned with the outlet portion of the outer mouthpiece portion, and wherein the exhaust portion and the outlet portion define an exhaust passage. The inner mouthpiece portion further comprises a first intake portion and a second intake portion distributed on an outer surface of the inner mouthpiece portion in the symmetrical arrangement, wherein a first and second air inlet channels are defined by an alignment of the first and second inlet portions of the outer mouthpiece portion with the respective first and second intake portions of the inner mouthpiece portion, wherein each of the first and second air inlet channel includes a proximal end open to an external environment and a distal end in communication with the body of the vaporizer device, and wherein the first and second air inlet channels are angularly offset relative to one another around the exhaust passage.

In another aspect, a mouthpiece assembly configured to engage a body of an atomization device is described according to another embodiment. The mouthpiece assembly includes an outer mouthpiece portion having an outlet portion and an inlet portion, and an inner mouthpiece portion removably engaged to at least an inner side of the outer mouthpiece portion, wherein the inner mouthpiece portion includes an exhaust portion having a first end in communication with the body of the atomization device and a second end aligned with the outlet portion of the outer mouthpiece portion, wherein the exhaust portion and the outlet portion define an exhaust passage, and an intake portion aligned with the inlet portion of outer mouthpiece portion to form an air inlet channel, wherein the air inlet channel includes a proximal end open to an external environment and a distal end in communication with the body of the vaporizer device.

These and other aspects and features of non-limiting embodiments of the present invention will become apparent to those skilled in the art upon review of the following description of specific non-limiting embodiments of the invention in conjunction with the accompanying drawings.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

Figure 1B:
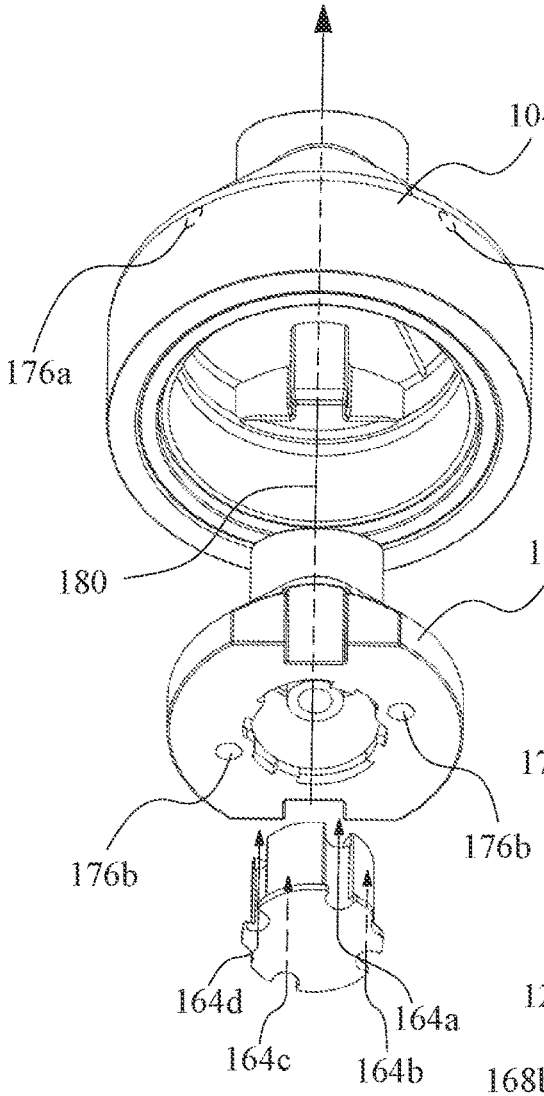
FIGS. 1A-B illustrate exploded views of an exemplary embodiment of a mouthpiece assembly in two different perspectives.

The drawings are not necessarily to scale and may be illustrated by phantom lines, diagrammatic representations and fragmentary views. In certain instances, details that are not necessary for an understanding of the embodiments or that render other details difficult to perceive may have been omitted.

DETAILED DESCRIPTION

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide an improved atomization device. The following detailed description describes the present embodiments, with reference to the accompanying drawings. In the drawings, reference numbers label elements of the present embodiments. These reference numbers are reproduced below in connection with the discussion of the corresponding drawing features. It is to be understood that the figures and descriptions of the present invention have been simplified to illustrate elements that are relevant for a clear understanding of the present invention, while eliminating, for the purpose of clarity, many other elements found in aromatherapy and vaporizing devices. Those of ordinary skill in the pertinent arts may recognize that other elements and/or steps are desirable and/or required in implementing the present invention. However, because such elements and steps are well known in the art, and because they do not facilitate a better understanding of the present invention, a discussion of such elements and steps is not provided herein. The disclosure herein is directed to all such variations and modifications to such elements and methods known to those skilled in the pertinent arts.

Embodiments of the present invention are described in detail hereinafter, and illustrations of the embodiments are shown in the drawings, wherein identical or similar reference numerals denote identical or similar elements or elements having the same or similar functions. The embodiments described hereinafter with reference to the drawings are exemplary and only intended to explain the present invention and cannot be understood as limiting the present invention.

Figure 1A:
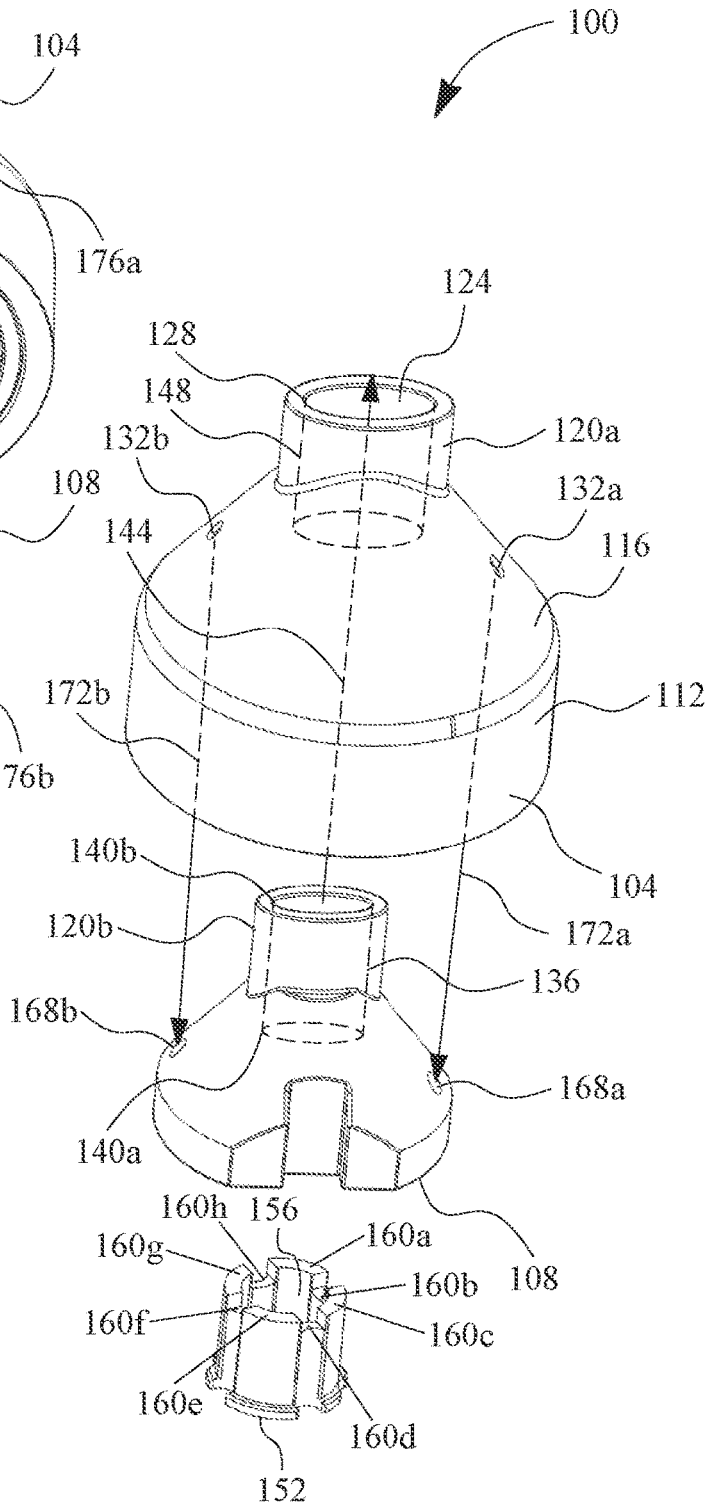

Now referring to FIGS. 1A-B, exploded views of an exemplary embodiment of a mouthpiece assembly 100, are illustrated in two different perspectives. As used in this disclosure, a "mouthpiece assembly" is one or more collective components that form a section of atomization device as described herein through which a user inhales vapor. Mouthpiece assembly 100 is configured to engage a body of an atomization device. In an embodiment, an atomization device includes mouthpiece assembly 100, and a main body assembly 800 (as described below with reference to FIG. 8). A "atomization device," for the purpose of this disclosure, is an apparatus designed to vaporize one or more substances for inhalation. In some cases, the atomization device may include a portable (e.g., hand-held) atomization device. In some cases, substances may include, without limitation, liquids, oils, waxes, dry herbs, and/or the like. In some cases, portable atomization device may be an electronic atomization device. As a non-limiting example, a portable atomization device may include a portable electronic atomizer configured to vaporize one or more substances as listed above without the combustion associated with smoking.

With continued reference to FIGS. 1A-B, mouthpiece assembly 100 removably engages the main body assembly of atomization device. In one or more embodiments, mouthpiece assembly 100 may removably engage the main body assembly in a variety of ways that include, without limitation, magnetic engagement, mechanical engagement, or a combination of the foregoing. Mouthpiece assembly 100 includes an outer mouthpiece shell or outer mouthpiece portion 104, and an inner mouthpiece insert or inner mouthpiece portion 108. In an embodiment, outer mouthpiece portion 104 may be made from various materials including, but not limited to, silica gel, silicon carbide, any other thermoplastic elastomers, or heat-insulating material that provide comfort and durability while ensuring a secure and adaptable fit to the user's mouth and to the body of atomization device. In other cases, outer mouthpiece portion 104 may also be made from metal, glass, ceramic, aluminum nitride, and quartz.

With continued reference to FIGS. 1A-B, as used in this disclosure, an "outer mouthpiece portion" is a part of mouthpiece assembly 100 with which the user directly interacts during inhalation. In an embodiment, outer mouthpiece portion 104 may include a lower cylindrical tubular portion 112 and an upper conical tubular portion 116 having a first hollow neck 120*a*. A "lower cylindrical tubular portion," for the purpose of this disclosure, is a lower part of outer mouthpiece portion 104, shaped as a cylinder, having a consistent diameter throughout its length. In some cases, lower cylindrical tubular portion 112 may include a part proximate to the body of the atomization device. In some cases, lower cylindrical tubular portion 112 may include an interface section that connects mouthpiece assembly 100 to the body of the atomization device. As a non-limiting example, lower cylindrical tubular portion 112 may be hollow and at least an inner surface of lower cylindrical tubular portion 112 may include one or more threads, magnets, or other mechanisms for attachment.

With continued reference to FIGS. 1A-B, a "upper conical tubular portion," for the purpose of this disclosure, is an upper part of outer mouthpiece portion 104, shaped as a cone, tapers from a wide base to a narrower top. In some cases, upper conical tubular portion 116 may be hollowed, wide base may be connected with lower cylindrical tubular portion 112, and narrower top may be connected with first hollow neck 120*a*. As a non-limiting example, upper conical tubular portion 116 may be proximate to, or be in contact with the user's mouth when inhaling. A "first hollow neck," for the purpose of this disclosure, is a transitional segment between the body of outer mouthpiece portion 104 (i.e., a combination of lower cylindrical tubular portion 112 and upper conical tubular portion 116) and a point of inhalation 124. In some cases, first hollow neck 120*a* may include at least an area where the user places their lips. In some cases, first hollow neck 120*a* May allow vapor to pass through. In some cases, first hollow neck 120*a* may have various shapes including, without limitation, oval, circular, and the like. As a non-limiting example, as shown in FIG. 1A, outer mouthpiece portion 104 may be generally funnel-shaped. In some cases, both outer mouthpiece portion 104 and inner mouthpiece portion 108 may have an outward appearance of being generally funnel-shaped.

With continued reference to FIGS. 1A-B, outer mouthpiece portion 104 includes an outlet portion 128. As used in this disclosure, an "outlet portion" is an end of mouthpiece from which vapor exits and is inhaled by the user. As a non-limiting example, outlet portion 128 may include a terminal end of mouthpiece assembly 100, wrapped by first hollow neck 120*a*. In some cases, outlet portion may include a tubular structure, and interior of first hollow neck 120*a* may include at least a portion of outlet portion 128. In an embodiment, outlet portion 128 of outer mouthpiece portion 104 may include at least an opening configured to deliver vapor from the atomization device to user's mouth. Outer mouthpiece portion 104 may also include one or more inlet portions 132*a-b*. As used in this disclosure, an "inlet portion" is an aperture designed to allow ambient air from external environment to enter mouthpiece assembly 100 and atomization device. One or more inlet portions 132*a-b* are distributed on an outer surface of outer mouthpiece portion 104. In some cases, one or more inlet portions 132*a-b* may be located on the exterior of upper conical tubular portion 116. In some cases, one or more inlet portions 132*a-b* may be positioned around the periphery of outer mouthpiece portion 104, on the outer surface of lower cylindrical tubular portion 112 or upper conical tubular portion 116.

With continued reference to FIGS. 1A-B, in some embodiments, each inlet portion of one or more inlet portions 132*a-b* may include a uniform shape such as a round or oval-shaped. As a non-limiting example, each inlet portion of one or more inlet portions 132*a-b* may include a diameter substantially smaller than the diameter of the outlet portion 128. In some cases, the size of each inlet portion of one or more inlet portions 132*a-b* may be calibrated to control the volume of ambient air that is drawn and further mixed with vapor. As a non-limiting example, larger inlet portions may cool vapor more while smaller inlet portions may restrict airflow. In some cases, one or more inlet portions 132*a-b* may be distributed at equal intervals on the outer surface of the upper conical tubular portion 116 or around the periphery of outer mouthpiece portion 104. As a non-limiting example, outer mouthpiece portion 104 may include outlet portion 128, and a first inlet portion 132*a* and a second inlet portion 132*b* distributed on the outer surface of outer mouthpiece portion 104, (more specifically, upper conical tubular portion 116 of outer mouthpiece portion 104) in a symmetrical arrangement as described in detail below.

With continued reference to FIGS. 1A-B, As used in this disclosure, a "symmetrical arrangement" is a design where components are positioned in a balanced and proportionate manner around a central point or axis. In an embodiment, first inlet portion 132*a* and second inlet portion 132*b* may be placed in a way that is evenly distributed and mirrors one side to the other. Such symmetrical arrangement of first inlet portion 132*a* and second inlet portion 132*b* on outer surface or outer mouthpiece portion 104 may be characterized by a mirrored configuration, as shown in FIG. 1A, with respect to a central axis that across a center of outlet portion 128 or exhaust passage as described in detail below. In some cases, symmetrical arrangement may maintain a consistent pattern and spacing around a circumference of outer mouthpiece portion 108. In some cases, each inlet portion of one or more inlet portions 132*a-b* may include a bore between exterior and interior surface of outer mouthpiece portion 104 ranging from 0~90 degrees relative to horizontal.

With continued reference to FIGS. 1A-B, in some cases, outer mouthpiece portion 104 may further include a chamfered wall, wherein the "chamfered wall," for the purpose of this disclosure, is a transitional surface or edge that connects lower cylindrical tubular portion 112 and upper conical tubular portion 116. As a non-limiting example, instead of a sharp angle or a direct meeting point between lower cylindrical tubular portion 112 and upper conical tubular portion 116, chamfer may provide a sloped or beveled edge to enhance the structural integrity of mouthpiece assembly 100 by reducing stress concentrations that may occur at a sharp corner. As a non-limiting example, outer mouthpiece portion 104 may include a 0~90 degrees chamfer between lower cylindrical tubular portion 112 and upper conical tubular portion 116.

With continued reference to FIGS. 1A-B, mouthpiece assembly 100 includes inner mouthpiece portion 108, wherein inner mouthpiece portion 108 is removably engaged with at least an inner side of outer mouthpiece portion 104. As used in this disclosure, an "inner mouthpiece portion" is a part of mouthpiece assembly 100 that is enclosed within outer mouthpiece portion 104 as described above. In an embodiment, inner mouthpiece portion 108 may include a structure similar to the structure of outer mouthpiece portion 104; for instance, and without limitation, inner mouthpiece portion 108 may fit within interior of outer mouthpiece portion 108 akin to a "Russian doll" setup. In some cases, inner mouthpiece portion 108 may mirror the shape and at least a portion of contours of outer mouthpiece portion 104 but on a smaller scale; for example, and without limitation, inner mouthpiece portion 108 may include a relatively smaller (in dimensionality e.g., diameter and height) lower cylindrical tubular portion, upper conical tubular portion, and a second hollow neck 120*b*.

With continued reference to FIGS. 1A-B, in one or more embodiments, inner mouthpiece portion 108 of the mouthpiece assembly 100 may include at least a cooling material selected from a group consisting of glass (e.g., borosilicate glass), ceramic (e.g., Zirconia), silicon carbide, metal, silicon, quartz, and other thermally conductive material known for their heat-resistance and ability to absorb and dissipate heat. In some embodiments, inner mouthpiece portion 108 may be glazed with material selected from the group consisting of glass (e.g., borosilicate glass), ceramic (e.g., Zirconia), silicon carbide, metal, silicon, quartz, and other thermally conductive material known for their heat-resistance and ability to absorb and dissipate heat. In one or more embodiments, inner mouthpiece portion 108 may include a non-reactive coating such as, without limitation, food-grade or medical-grade coating made from silicone, PTFE, or other inert substances that are resistant to high temperatures and chemical reactions. In some cases, inner mouthpiece portion 108 containing at least a cooling material may have a cooling effect on the vapor by increasing heat dissipation and allowing heat to transfer from vapor to inner mouthpiece portion 108. In some cases, an outer surface layer of inner mouthpiece portion 108 may undergo a finishing process (e.g., polishing) to create a smooth texture to reduce any friction when inserting or removing inner mouthpiece portion 108 from outer mouthpiece portion 104.

With continued reference to FIGS. 1A-B, in some cases, attachment of inner mouthpiece portion 108 to outer mouthpiece portion 104 may utilize one or more physical properties of the materials involved to secure the connection. As a non-limiting example, outer mouthpiece portion may be fabricated from a flexible and high-friction material such as rubber or a rubber-like elastomer as described above, which may grip inner mouthpiece portion 108 tightly due to the natural tension and friction provided by such material. In these cases, inner mouthpiece portion 108, made from a smooth and rigid material e.g., glass or ceramic as described above, may be inserted from the bottom, i.e., the opening of lower cylindrical tubular portion 112 of outer mouthpiece portion 104. Elasticity of the rubber may exert a consistent inward pressure on the outer surface of inner mouthpiece portion 108, resulting in a secure and stable friction fit. Such attachment may allow for an improvement to create easy removal for cleaning or replacement without the need for additional fastening hardware or tools. As a non-limiting example, outer mouthpiece portion 108 may be designed with a pliable structure that enables it to be peeled back from inner mouthpiece portion 104 at outlet portion 128. In some cases, outer mouthpiece portion 108 may be temporarily deformed or rolled back upon itself without physical damage; therefore, exposing at least a portion (e.g., upper conical tubular portion and/or second hollow neck 120*b*) while still remaining attached to inner mouthpiece portion 108. Once cleaning is complete, outer mouthpiece portion 104 may be returned to its original position, re-encasing inner mouthpiece portion 108. Other exemplary attachment mechanisms may include, without limitation, threaded connection, magnetic attachment, bayonet mount, push-fit or press-fit, and the like. Removable engagement is further described in detail below with reference to FIGS. 2A-B and 3A-B.

With continued reference to FIGS. 1A-B, inner mouthpiece portion 108 may include an exhaust portion 136. As used in this disclosure, an "exhaust portion" is a part on inner mouthpiece portion 108 configured to channel the vaporized substance from heated chamber or heating bowl (as described below with reference to FIG. 8) to the user. In one or more embodiments, exhaust portion 136 may be designed to channel the vapor from heating bowl to one end of outlet portion 128 of outer mouthpiece portion 104. As a non-limiting example, exhaust portion 136 may include a tubular structure; Exhaust portion includes a first end 140*a* in communication with body of atomization device and a second end 140*b* aligned with outlet portion 128 of outer mouthpiece portion 104. In some cases, first end 140*a* of exhaust portion 136 may be generally cylindrical longitudinally with a circular cross-section laterally, while second end portion 140*b* of exhaust portion 136 may be defined by an interior bore of second hollow neck 120*b*, with an oval cross-section laterally.

With continued reference to FIG. 1, a conjunction of exhaust portion 136 of inner mouthpiece portion 108 and outlet portion 128 of outer mouthpiece portion 104 defines an exhaust passage 144. As used in this disclosure, an "exhaust passage" is a continuous airway or channel through which vapor travels from the vaporization source to the user. In some cases, vaporization source may be located at heating bowl within the body of atomization device. As a non-limiting example, exhaust passage 144 may include a primary pathway or main duct within the electronic atomization device that guides vapor from where it is produced to point of inhalation 124. In some cases, exhaust passage 144 may include a first portion enclosed in mouthpiece assembly 100 and a second portion enclosed in the body of atomization device. In one or more embodiments, exhaust passage may include at least a portion being an air exchange chamber as described below with reference to FIGS. 3A-B.

With continued reference to FIGS. 1A-B, in some cases, at least a portion of exhaust portion 136 of inner mouthpiece portion 108 may extend into outlet portion 128 of outer mouthpiece portion 108. As a non-limiting example, second end portion 140*b* of exhaust portion 136 may have a relatively smaller diameter; second end portion 140*b* of exhaust portion 136 may be inserted into outlet portion 128 of outer mouthpiece portion 104 from the bottom. In an embodiment, exhaust portion 136 of inner mouthpiece portion 108 may be encased by second hollow neck 120*b* which forms a lower portion of exhaust passage 144. In some cases, second end 140*b* of exhaust portion 136 may include an intake in communication with an interior of first hollow neck 120*a* of outer mouthpiece portion 104, wherein second hollow neck 120*b* may extends through at least a portion of first hollow neck 120*a*. When the inner mouthpiece portion 108 is inserted within outer mouthpiece portion 104, second hollow neck 120*b* of inner mouthpiece portion 108 may be inserted into and disposed within an interior bore of the first hollow neck 120*a* of the outer mouthpiece shell 104.

With continued reference to FIGS. 1A-B, in some cases, a top end of second hollow neck 120*b* will not extend beyond a top end of first hollow neck 120*a*, with the top end of second hollow neck 120*b* at or recessed slightly below the top end of first hollow neck 120*a*. Alternatively, second hollow neck 120*b* may extend through a bottom opening of outlet portion 128 such that a length of second hollow neck 120*b* extends beyond first hollow neck 120*a*. In some cases, interior bore of first hollow neck 120*a* may be sized and shaped to receive an exterior of second hollow neck 120*b*. In some cases, inner mouthpiece portion 108 may be completely removed from outer mouthpiece portion 104 for cleaning and/or maintenance. Removable engagement of outer mouthpiece portion 104 and inner mouthpiece portions 108 as described above may also allow inner mouthpiece portion 108 to be replaced with a different inner mouthpiece portion (e.g., an inner mouthpiece portion having only two or only one air inlet channels as described in further detail below) that affect airflow, vapor heat, as well as the effectiveness of the airflow inside the atomization device as described herein. As a non-limiting example, exhaust passage 144 may include a channel 148 defined by exterior of inner mouthpiece portion 108, with a portion of exhaust passage 144 defined by the channel 148 and a portion of an interior wall of outer mouthpiece portion 104 opposite the channel 148, wherein the channel 148 may include at least one end in communication with an interior of interior of second hollow neck 120*b* of exhaust portion 136 of inner mouthpiece portion 108.

With continued reference to FIGS. 1A-B, in one or more embodiments, inner mouthpiece portion 108 may additionally, or alternatively, include a reservoir 152 (or a vapor condensation trap) disposed within inner mouthpiece portion 108 between or below first and second ends 144*a-b* of exhaust portion 136, configured to collect excess moisture and condensation that may form during the vaporization process. In some cases, reservoir 152 may be a detachable insert that fits into inner mouthpiece portion 108. In some cases, reservoir 152 may include a shape that corresponds to interior contours of inner mouthpiece portion 108. In an embodiment, reservoir 152 may be generally cylindrical longitudinal with a circular cross-section laterally. In some cases, the diameter of reservoir 152 may be greater than the diameter of first end 144*a* and/or second end 144*b* of exhaust portion 136. In other cases, exhaust portion 136 may be same shape and/or dimensions between first end 144*a* and second end 144*b* with or without reservoir 152 disposed between.

With continued reference to FIGS. 1A-B, in an embodiment, reservoir 152 may include a recessed chamber 156 (e.g., central hollow or cavity) defined by a plurality of alternating concaved walls 160*a-h* that extend outward and inward. In some cases, each concaved wall may be curved or in a variety of shapes (e.g., parabolic, elliptical, rectangular, triangular, or the like). As a non-limiting example, and as shown in FIG. 1A, plurality of alternating concaved walls 160*a-h* may include concaved walls 160*a*, 160*c*, 160*e*, and 160*g* may bulge outwardly, while other concaved walls of plurality of alternating concaved walls 160*a-h* such as concaved walls 160*b*, 160*d*, 160*f*, and 160*h* may curve inwardly. Each concaved wall of plurality of alternating walls may be semi-circular in geometry. Such alternating pattern of convex and concave walls may work in conjunction with an interior surface of lower portion of exhaust portion 136 to create a plurality of air outlet channels 164*a-d* upon an insertion of reservoir 152 into inner mouthpiece portion 108 as show in FIG. 1B. As described in this disclosure, an "air outlet channel" is an air pathway within exhaust passage 144 designed to guide the flow of air and vapor from air exchange chamber to first end 140*a* of exhaust portion 136. In some cases, each air outlet channel of plurality of air outlet channels 164*a-d* may be generally semi-cylindrical longitudinally with a semi-circular cross-section laterally.

With continued reference to FIGS. 1A-B, in some cases, plurality of air outlet channels 164*a-d* may be created at equal intervals around the periphery of reservoir 152 to ensure the efficient flow of vapor while trapping condensation. In some cases, inner surface of inner mouthpiece portion 108 may include a circular ceiling that connects with first end 140*a* of exhaust portion 136, having a profile identical to a lower rim of reservoir 152, wherein the ceiling may be above upper edges of plurality of alternating concaved walls 160*a-h* in a pre-determined distance, thus, at least in part, first end 140*a* of exhaust portion 136 may not be in physical contact with the bottom of recessed chamber 156 of reservoir 152, maintaining an air gap to allow vapor to pass through when reservoir 152 is inserted. As a non-limiting example, as the atomized mixture of vapor and gas rises from heating bowl towards second end 140*b* of exhaust portion 136, vapor condenses along the walls of exhaust portion 136, especially towards second end 140*b* of exhaust portion 136 and slides downward and into reservoir 152. Reservoir 152 may be configured to prevent the condensation from re-entering the vapor stream; for instance, and without limitation, reservoir 152 may be sealed with an O-ring at an insert opening on the bottom surface of inner mouthpiece portion 108. In some cases, the number of air outlet channels 164*a-d* may depend on the number of concaved walls that bulged outwardly. Additionally, or alternatively, as the condensed vapor builds up along the lower rim of reservoir 152, the condensed vapor may slide downward and drips back down into heating bowl where the condensed vapor is once again heated.

With continued reference to FIGS. 1A-B, inner mouthpiece further includes one or more intake portions 168*a-b* distributed on outer surface of inner mouthpiece portion, wherein each intake portion of the one or more intake portions is aligned with each inlet portion of one or more inlet portions 132*a-b* to form a plurality of air inlet channels 172*a-b*. As used in this disclosure, an "intake portion" is an opening designed to allow gases, external to inner mouthpiece portion 108, to enter into the atomization device. An "air inlet channel," for the purpose of this disclosure, is a pathway that connects inlet portion and intake portion towards heating bowl or the area where the vapor is generated. In an embodiment, when mouthpiece 100 is assembled, alignment one or more intake portions 168*a-b* and one or more inlet portions 132*a-b* respectively may create plurality of air inlet channels 172*a-b* to direct ambient air to flow into the body of atomization device from external environment. In some cases, the number of plurality of intake portions 168*a-b* may be the same as the number of plurality of inlet portions 132*a-b* and symmetrical arrangement as described above may be applied. In some cases, each intake portion of one or more intake portions 168*a-b* may have the same or relatively smaller diameter as of each inlet portion of one or more inlet portions 132*a-b*. In some cases, each intake portion of one or more intake portions 168*a-b* may include a circular, oval, or slotted shape. In some cases, one or more intake portions 168*a-b* may be distributed at equal intervals on outer surface around a periphery of inner mouthpiece portion 108.

With continued reference to FIGS. 1A-B, in an embodiment, each air inlet channel 172*a-b* may include an intake passage, defined by outer and inner mouthpiece portions 104, 108, including each inlet portion of one or more inlet portions 132*a-b* and each intake portion of one or more intake portions 168*a-b*, wherein the direction of the air flow is indicated by the downwardly pointed arrows illustrated in FIG. 1A. In some cases, mouthpiece assembly 100 as described herein may include total of 2, 3, 4, 6, 8, or as many air inlet channels or intake passages as desired, each having an inlet portion on the outer mouthpiece portion 104 and an intake portion on the inner mouthpiece portion 108. In a non-limiting embodiment, each inlet or intake portion of one or more inlet or intake portions 132*a-b*, 168*a-b* may be located on a side of the mouthpiece assembly 100, for example, and without limitation, outer surface of lower cylindrical tubular portion. In other embodiments, each inlet or intake portion of one or more inlet or intake portions 132*a-b*, 168*a-b* may be located elsewhere, for example, and without limitation, outer surface of upper conical tubular portion. In some cases, a user could block an intake passage by placing a finger or other obstruction over inlet portion on outer mouthpiece portion 104 to effectively mimic the air intake conditions that would exist if the outer mouthpiece portion 104 had the rest of intake passage or air inlet channels.

With continued reference to FIGS. 1A-B, each air inlet channel of plurality of air inlet channels 172*a-b* may include a proximal end 176*a* open to an external environment and a distal end 176*b* in communication with the body of atomization device. In one or more embodiments, said proximal end 176*a* may include an interior bore of inlet portion on outer mouthpiece portion 104 and said distal end 176*b* may include an interior bore of intake portion on inner mouthpiece portion 108. As a non-limiting example, proximal end 176*a* of each air inlet channel of plurality of air inlet channels 172*a-b* may include an entry point for ambient air while distal end 176*b* may include an exit point for the ambient air. In some embodiments, distal end 176*b* may in fluidic communication with air exchange chamber, wherein the "fluidic communication," for the purpose of this disclosure, refers to the passage of flow of fluids between components or chambers in a manner that allows for the intended function of vaporization, mixing, or conditioning of the vapor to occur without obstruction or unwanted interference. In some cases, any communication between two or more components as described herein may be in fluidic communication.

With continued reference to FIGS. 1A-B, as a non-limiting example, a mixture flow 180 (e.g., mix of vapor and ambient air) may be draw from heating bowl within the body of atomization device, directly or indirectly underneath removable reservoir 152 upon inhalation by the user. In some cases, mixture flow 180 may be diverged, by plurality of air outlet channels 164*a-d*, as shown in FIG. 1B, into a plurality of distributaries (i.e., smaller streams), wherein the plurality of distributaries may be subsequently merged into mixture flow 180 within the airgap at first end 140*a* of exhaust portion 136, pass through channel 148, and then enter into user's mouth at outlet portion 128 of outer mouthpiece portion 104 as indicated by the upwardly pointed arrows shown in FIGS. 1A-B. Condensation formed during the said process may be collected in the recessed chamber 156 of reservoir 152 within inner mouthpiece portion 108.

With continued reference to FIGS. 1A-B, in a non-limiting embodiment, inner mouthpiece portion 108 may include two air inlet channels, for example, and without limitation, a first and a second air inlet channel 172*a*, 172*b*, defined by an alignment of first and second inlet portion 132*a*, 132*b* of outer mouthpiece portion 104 with respective first and second intake portions 168*a*, 168*b* of inner mouthpiece portion 108. Both first and second air inlet channel 172*a*, 172*b* may include a proximal end 176*a* open to external environment and a distal end 176*b* in fluidic communication with the body of atomization device. First and second air inlet channels 172*a*, 172*b* are angularly offset relative to one another around exhaust passage 144. As used in this disclosure, "angularly offset" means to the positioning of two elements in such a way that they form an angle with each other around a central point or axis. If first air inlet channel 172*a* and second air inlet channel 172*b* are angularly offset, first air inlet channel 172*a* and second air inlet channel 172*b* may not be aligned along the same radial line from the center of mouthpiece assembly 100 i.e., longitudinal axis of exhaust passage 144, but are instead situated at a desired angle from one another to create a vortex or enhancing the missing of ambient air with the vapor as described in further detail below with reference to FIG. 7. As a non-limiting example, angular offset of the first and second air inlet channels relative to one another is set at an angle ranging between 0 and 90 degrees.

Figure 2B:
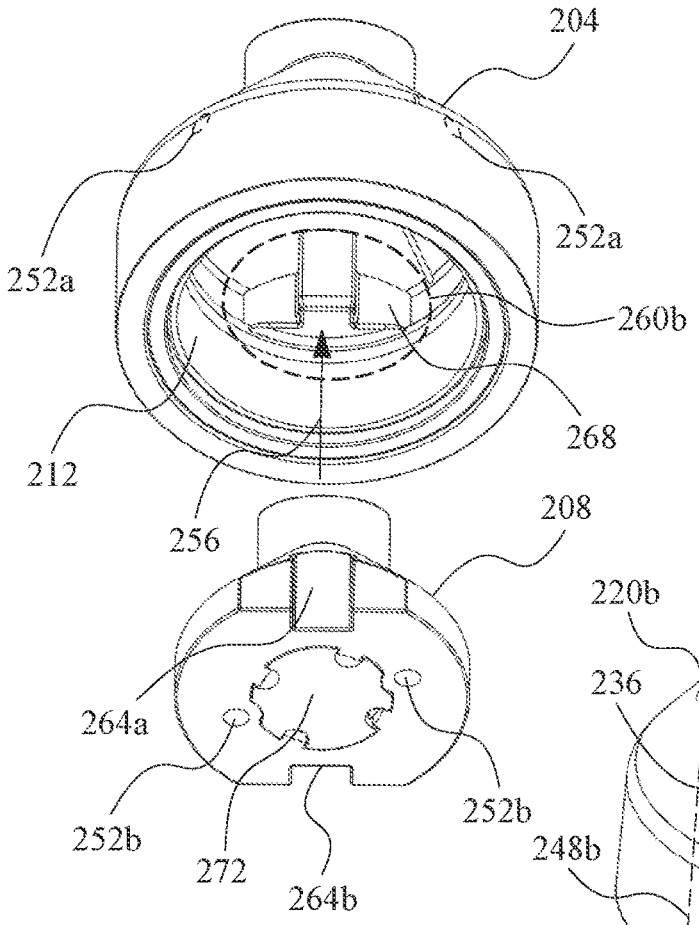
FIGS. 2A-B illustrate exploded views of an exemplary embodiment of mouthpiece assembly in two different perspectives.
Figure 2A:
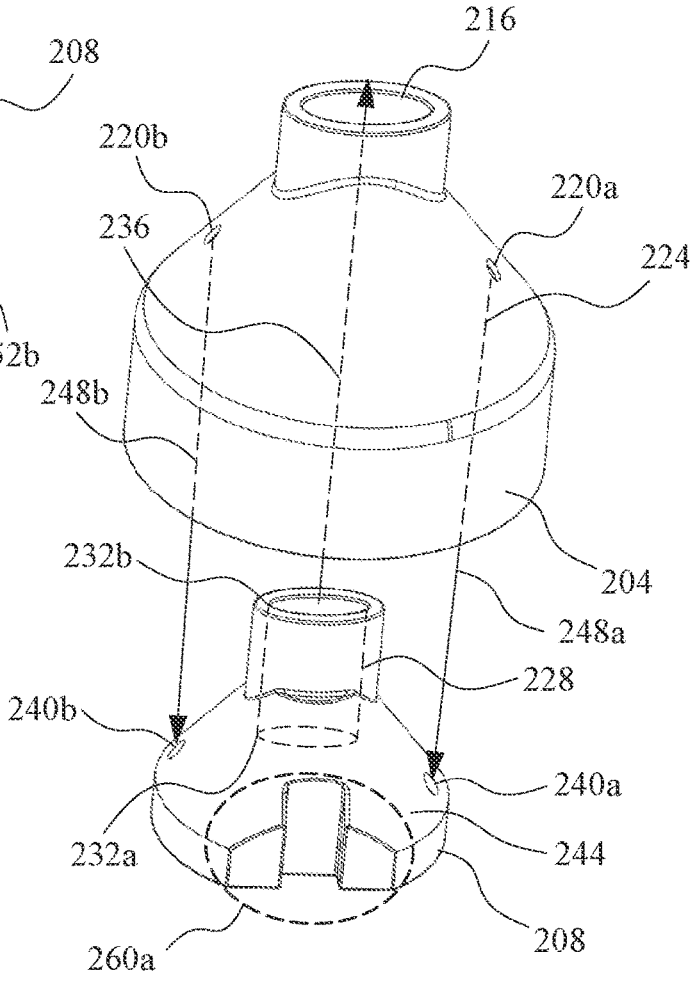

Now referring to FIGS. 2A-B, exploded views of an exemplary embodiment of mouthpiece assembly 200 are illustrated in two different perspectives. In a non-limiting embodiment, as described above with reference to FIGS. 1A-B, a mouthpiece assembly 200 configured to engage the body of an atomization device, includes an outer mouthpiece portion 204 and an inner mouthpiece portion 208 removably engaged to at least an inner side 212 of the outer mouthpiece portion 204, wherein the outer mouthpiece portion 204 includes an outlet portion 216 and a first inlet portion 220*a* and a second inlet portion 220*b* distributed on an outer surface 224 of outer mouthpiece portion 204 in a symmetrical arrangement, and wherein the inner mouthpiece portion 208 includes an exhaust portion 228 having a first end 232*a* in communication with the body of atomization device and a second end 232*b* aligned with the outlet portion 216, defining an exhaust passage 236. Inner mouthpiece portion 208 further include a first intake portion 240*a* and a second intake portion 240*b* distributed on an outer surface 244 of inner mouthpiece portion 208 in the symmetrical arrangement wherein a first and second air inlet channels 248*a*, 248*b* are defined by an alignment of the first and second inlet portions 220*a*, 220*b* of the outer mouthpiece portion 204 with the respective first and second intake portion 240*a*, 240*b* of the inner mouthpiece portion 208. Each of first and second air inlet channel 248*a*, 248*b* includes a proximal end 252*a* open to an external environment and a distal end 252*b* in communication with the body of the atomization device, and wherein the first and second air inlet channels 248*a*, 248*b* are angularly offset relative to one another around the exhaust passage 236.

With continued reference to FIGS. 2A-B, in one or more embodiments, alignment of first and second inlet portion 220*a*, 220*b* and first and second intake portion 240*a*, 240*b* may be configured to introduce a controlled restriction, or a "choke," at a point where inner mouthpiece portion 208 and outer mouthpiece portion 204 engage. As used in this disclosure, a "choke" is a portion with a controlled restriction. In a non-limiting example, first and second inlet portion 220*a*, 220*b* may be deliberately offset first and second intake portion 240*a*, 240*b*; for instance, and without limitation, proximal end 252*a* and distal end 252*b* of first air inlet channel 248*a* and/or second air inlet channel 248*b* may not be on the same axis, therefore, in some cases, creating a choke point that constrict ambient air flow between outer mouthpiece portion 204 and inner mouthpiece portion 208 when they are engaged, which induce a Venturi effect. Venturi effect occurs as the air is forced through a narrowed passage, resulting in increased air velocity and a corresponding decrease in air pressure at the choke point. In some cases, reduced pressure may facilitate the production and/or drawing of vapor at, or from heating bowl more efficiently, as the faster-moving ambient air may entrain the vapor into the airflow stream. In other embodiments, such choke point may be introduced by engaging two mouthpiece portions having different diameter at inlet and/or intake portions. In some cases, choke may be disposed at any point along the corresponding air inlet channel.

With continued reference to FIGS. 2A-B, in some cases, removable engagement 256 between inner mouthpiece portion 208 and outer mouthpiece portion 204 may include one or more interface features 260. As used in this disclosure, an "interface feature" is a specific aspect or element of a component that is configured to connect or interact with another component. In some cases, interface features 260*a-b* may include one or more complementary shapes or structures that enable two parts (e.g., inner mouthpiece portion 208 and outer mouthpiece portion 204) to join together. In an embodiment, inner mouthpiece portion 208 may include a first interface feature 260*a* configured to accommodate a second interface feature 260*b* on inner side 212 of outer mouthpiece portion 204. As a non-limiting example, as shown in FIG. 2B, outer surface 244 of inner mouthpiece portion 208 may include a female interface feature 260*a* having a plurality of recessed grooves 264*a-b*, wherein each recessed groove of the plurality of recessed grooves 264*a-b* is configured to accommodate a corresponding protrusion 268 of a male interface feature 260*b* on inner side 212 of outer mouthpiece portion 204. As another non-limiting example, female and male interface feature 260*a*, 260*b* as described in previous example may be configured in reverse, wherein male interface feature 260*b* with plurality of protrusions may be located on inner mouthpiece portion 208, and female interface feature 260*a* with plurality of recessed grooves 264*a-b* may be situated on inner side 212 of outer mouthpiece portion 204.

With continued reference to FIGS. 2A-B, in one or more embodiments, inner mouthpiece portion 208 may include one or more indentations or cavities (i.e., recessed grooves) having one or more indented lines or channels in female interface feature 260*a* designed to align with and receive protruding elements (i.e., protrusions) from male interface feature 260*b*, wherein the depth, width, and/or shape of each groove may be identical to each protrusion. In some cases, each protrusion of plurality of protrusions 268 may include a ridge designed to fit into each recessed groove of plurality of recessed grooves 264*a-b*. Such male interface feature 260*b* may be a counterpart to female interface feature 264*a* and/or 264*b*, thus, in at least a non-limiting example, (first and second protrusions of) male interface feature 260*b* may protrudes or extends outward to engage with (first and second recessed grooves 264*a*, 264*b* of) female interface feature 260*a* respectively. In a further non-limiting embodiment, as shown in FIGS. 2A-B, inner mouthpiece portion 208 may include a reservoir 272 mechanically fixed to the base of inner mouthpiece portion 208. It should be noted that, in some cases, the number of interface features and the size of each interface feature may vary based on different design, for example, and without limitation, a first pair of female-male interface features may be larger or smaller than a second pair of female-male interface features in dimensionality, providing a desired flexibility and stability for mouthpiece assembly 200.

Figure 3A:
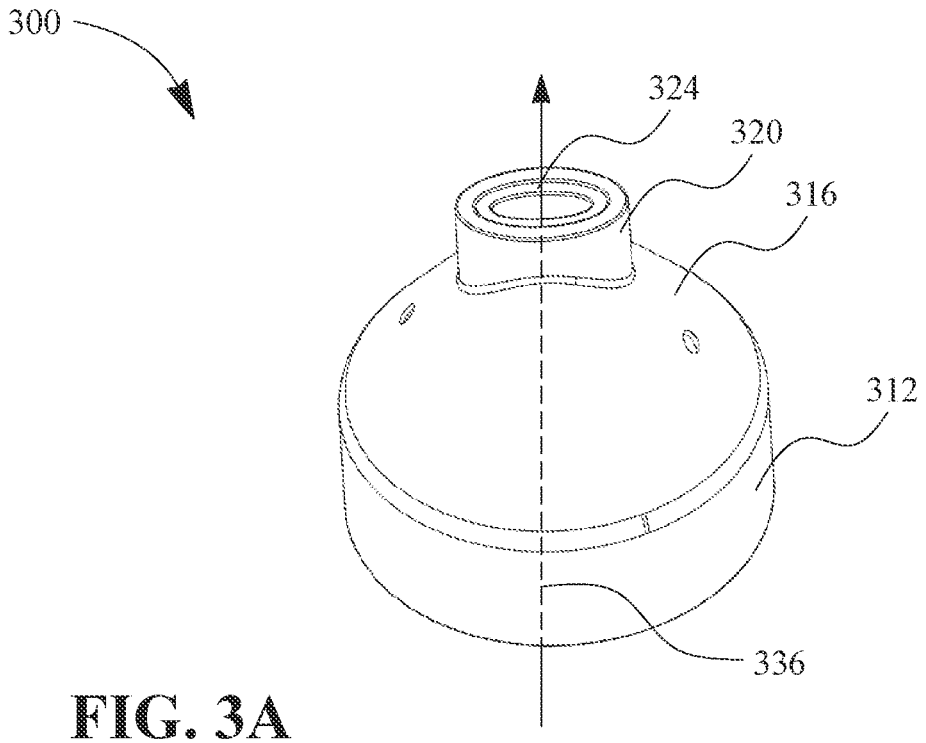
FIGS. 3A-B illustrate perspective views of an exemplary embodiment of a mouthpiece assembly having an outer mouthpiece portion and an inner mouthpiece portion engaged.
Figure 3B:
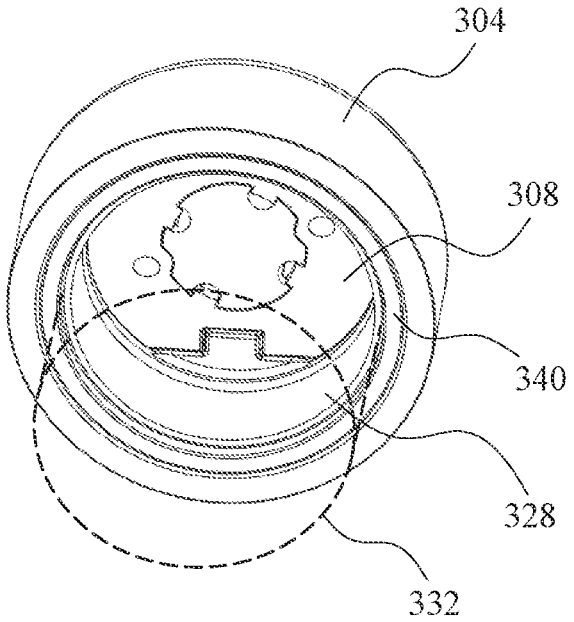

Now referring to FIGS. 3A-B, perspective views of an exemplary embodiment of a mouthpiece assembly 300 having an outer mouthpiece portion 304 and an inner mouthpiece portion 308 engaged are illustrated. In one or more embodiments, as described above with reference to FIGS. 1-2 and as shown in FIG. 3A, outer mouthpiece portion 304 may include a lower cylindrical tubular portion 312, an upper conical tubular portion 316, and a first hollow neck 320. In some cases, once inner mouthpiece portion 308 is engaged with outer mouthpiece portion 304, outer surface of inner mouthpiece portion 308 may fit to an interior of upper conical tubular portion 316. Exhaust portion of inner mouthpiece portion 308 may extend into outlet portion 324 of outer mouthpiece portion 304. As a non-limiting example, at least a portion of first hollow neck 320 may include a second hollow neck (not shown) of inner mouthpiece portion 308, wherein the second hollow neck may include second end of exhaust portion of inner mouthpiece in communication with an interior of the rest of outlet portion 324 within first hollow neck 320. In one or more embodiments, base of inner mouthpiece portion 308 and an inner surface 328 of lower cylindrical tubular portion 312 may define an air exchange chamber 332. As used in this disclosure, an "air exchange chamber" is a specialized section within exhaust passage 336 configured to facilitate the mixing or exchange of intake ambient air with the vaporized substance. As a non-limiting example, as shown in FIG. 3B, air exchange chamber 332 may include a space defined by lower cylindrical tubular portion 312 of outer mouthpiece portion 304, below upper conical tubular portion 316 and base of inner mouthpiece portion 308, and heating bowl within the body of atomization device.

With continued reference to FIGS. 3A-B, additionally, or alternatively, mouthpiece assembly as described here may include a removable fixation component 340. As used in this disclosure, a "removable fixation component" is a part configured to securely attach or fix one component to another while allowing its easy removal when necessary. In one or more embodiments, removable fixation component 340 may provide a stable connection that maintains the integrity of mouthpiece assembly 300 and the body of atomization device during use but may be detached without the use of tools or excessive force for purposes such as cleaning, maintenance, and/or replacement as described above with reference to FIGS. 1-2. Exemplary removable fixation component 340 may include, without limitation, a clip, latch, magnet, threaded cap, snap-fit mechanism, or any other type of connector that allows for manual engagement and disengagement. As a non-limiting example, removable fixation component 340 may include a ring-shaped magnet configured to removably attach outer mouthpiece portion 304 to the body of atomization device as described below with reference to FIGS. 4A-B and 8.

Figure 4A:
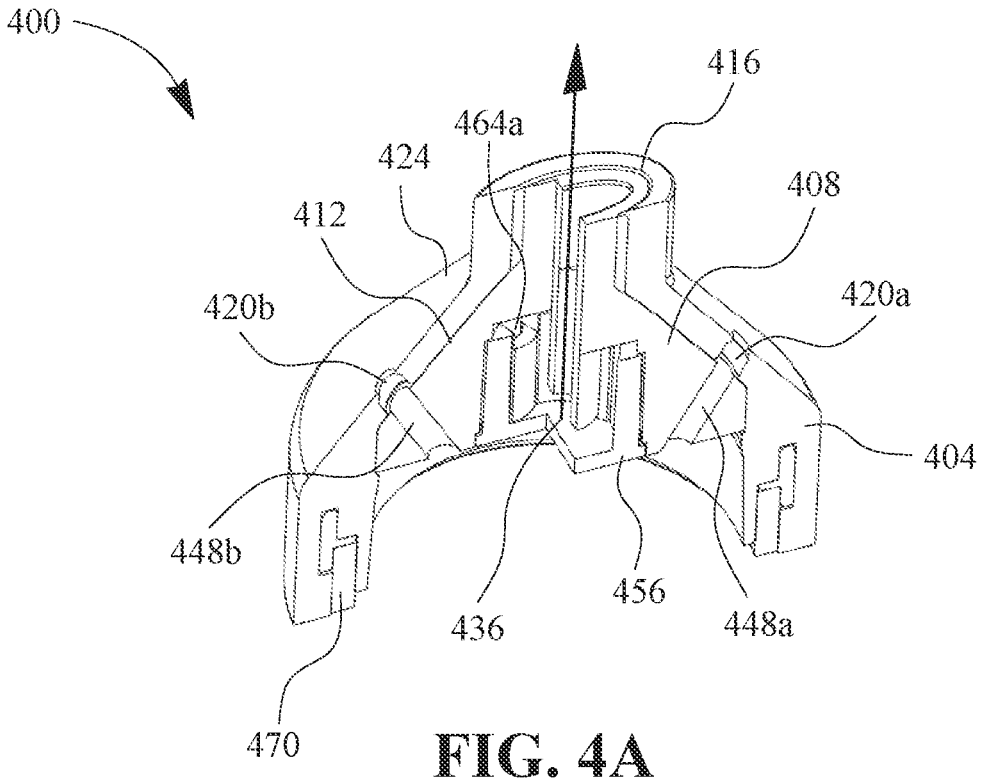
FIGS. 4A-B illustrate perspective cross-sectional views of an exemplary embodiment of the mouthpiece assembly.
Figure 4B:
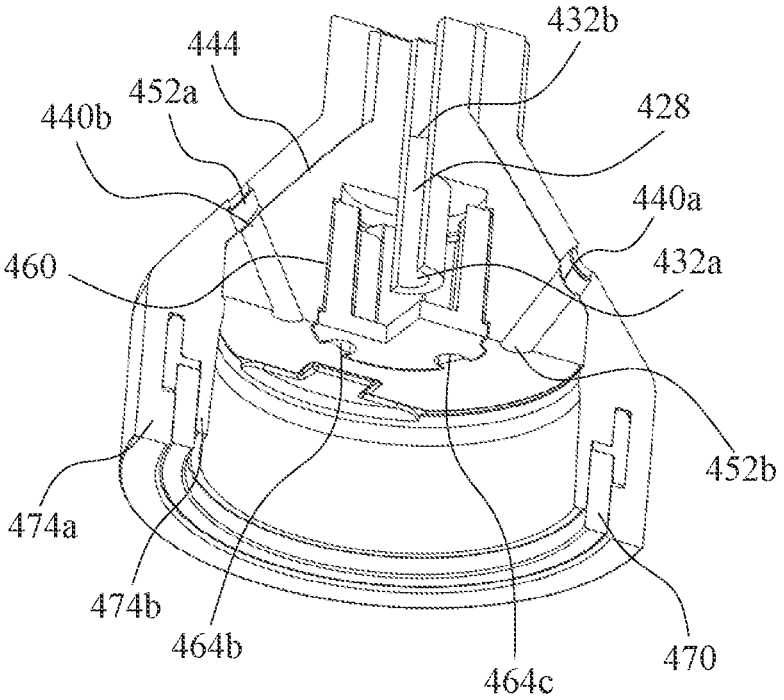

Now referring to FIGS. 4A-B, cross-sectional views of an exemplary embodiment of mouthpiece assembly 400 are illustrated. In a non-limiting example, as described above with reference to FIGS. 1-3, mouthpiece assembly 400 configured to engage the body of an atomization device, includes an outer mouthpiece portion 404 and an inner mouthpiece portion 408 removably engaged to at least an inner side 412 of the outer mouthpiece portion 404, wherein the outer mouthpiece portion 404 includes an outlet portion 416 and a first inlet portion 420*a* and a second inlet portion 420*b* distributed on an outer surface 424 of outer mouthpiece portion 404 in a symmetrical arrangement, and wherein the inner mouthpiece portion 408 includes an exhaust portion 428 having a first end 432*a* in communication with the body of atomization device and a second end 432*b* aligned with the outlet portion 416, defining an exhaust passage 436. Inner mouthpiece portion 408 further include a first intake portion 440*a* and a second intake portion 440*b* distributed on an outer surface 444 of inner mouthpiece portion 408 in the symmetrical arrangement wherein a first and second air inlet channels 448*a*, 448*b* are defined by an alignment of the first and second inlet portions 420*a*, 420*b* of the outer mouthpiece portion 404 with the respective first and second intake portion 440*a*, 440*b* of the inner mouthpiece portion 408. Each of first and second air inlet channel 448*a*, 448*b* includes a proximal end 452*a* open to an external environment and a distal end 452*b* in communication with the body of the atomization device, and wherein the first and second air inlet channels 448*a*, 448*b* are angularly offset relative to one another around the exhaust passage 436. Additionally, or alternatively, inner mouthpiece portion 408 may include a reservoir or a reservoir insert 456 having a plurality of alternating concaved walls. Reservoir 456, when the reservoir 456 inserted into the base of inner mouthpiece portion 408, together with inner surface 460 of inner mouthpiece portion 408, defines a plurality of air outlet channels 464*a-c*.

With continued reference to FIGS. 4A-B, as a non-limiting example, mouthpiece assembly 400 may include a ring-shaped magnet 470, wherein the ring-shaped magnet 470 may include a circular ring having a diameter approximate or equal to a lower rim 474 of lower cylindrical tubular portion of outer mouthpiece portion 404 that fit snugly around lower cylindrical tubular portion of outer mouthpiece portion 404 of mouthpiece assembly 400 and provide a substantial magnetic force to securely attach outer mouthpiece portion 404 to the body of the atomization device. In some cases, ring-shaped magnet may be removed from or inserted into outer mouthpiece portion 404 as needed, for example, and without limitation, lower rim 474 of lower cylindrical tubular portion of outer mouthpiece portion 404 may include two layers 474*a-b* designed to accommodate ring-shaped magnet, wherein the two layers 474*a-b* may create a sandwich-like structure with ring-shaped magnet 470 fitting securely between them. In some cases, due to the elastic properties of rubber, user may peel back or deform one of the two layers (either first layer 474*a* or second layer 474*b*) at lower rim 474 of outer mouthpiece portion 404 and remove or reinsert ring-shaped magnet 470. Once reinserted ring-shaped magnet 470, layers 474*a-b* of lower rim 474 may naturally return to their original shape and position, enclosing ring-shaped magnet 470 securely again.

Figure 5:
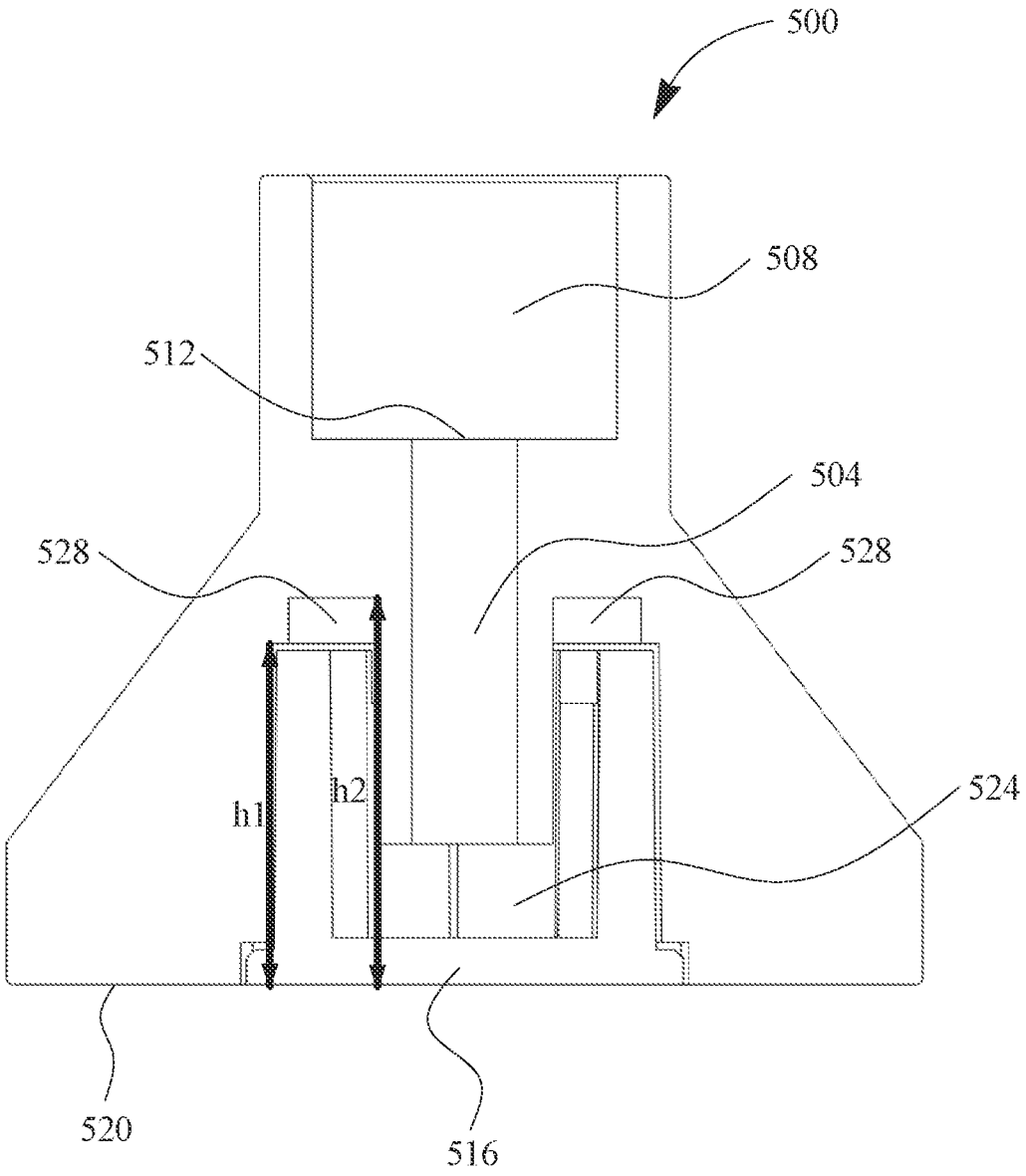
FIG. 5 illustrates a cross-sectional view of an exemplary embodiment of an inner mouthpiece portion of the mouthpiece assembly.

Now referring to FIG. 5, a cross-sectional view of an exemplary embodiment of an inner mouthpiece portion 500 is illustrated. The exhaust portion may be defined by the interior bore of second hollow neck. A first end portion 504 of the exhaust portion may be in communication with the body of atomization device (i.e., heating bowl of the atomizer assembly), and a second end portion 508 of exhaust portion may be in communication with outlet portion, with a middle portion 512 of the exhaust portion disposed between the first and second end portions 504, 508 and in communication therewith. In one or more embodiments, the bore of first end portion 504 may be cylindrical and vertically oriented, the bore of the second end portion 508 is generally cylindrical and horizontally oriented, and the bore of the middle portion 512 is generally cylindrical and vertically oriented.

With continued reference to FIG. 5, inner mouthpiece portion 500 may include a reservoir 516 having a plurality of alternating concaved walls may be inserted into a base 520 of inner mouthpiece portion 500. In some cases, reservoir may include a recessed chamber 524 configured to collect excessive moisture or condensation formed during vaporization. In some cases, reservoir 516 may include a height $h_1$ and inner mouthpiece portion 500 may include a cavity having a height $h_2$ (both heights are measured from the base 520 of inner mouthpiece portion 500 to a point on an upper most edge aligned in a vertical axis), wherein $h_2>h_1$; thus, insertion of reservoir 516 into inner mouthpiece portion 500 may create an air gap 528 to allow vapor and/or airflow to pass through, merge within recessed chamber 524 at the entry of first end portion 504, and further be drawn out through exhaust portion (from first end portion 504, middle portion 512, and then second end portion 508) upon user inhalation.

With continued reference to FIG. 5, in one or more embodiments, in some embodiments, middle portion 512 may include a transition portion that connects two end portions 504, 508 of exhaust portion, each having a different cross-sectional shape. As a non-limiting example, one section of exhaust portion may have a circular cross-section, while the adjacent section may have an oval or rectangular cross-section. In some cases, middle portion 512 may include a point of change in cross-sectional profiles. In one or more embodiments, second end portion 508 having a wider diameter may reduce the velocity of the vapor, while first end portion 504 having a narrower diameter may increase the speed, possibly condensing the vapor. In some cases, middle portion 512 may be designed to change in exhaust portion's shape which does not disrupt the vapor flow or create any turbulence. As a non-limiting example, middle portion 512 may include a tapering section (from second end portion 508 to first end portion 504) within exhaust portion.

Figure 6:
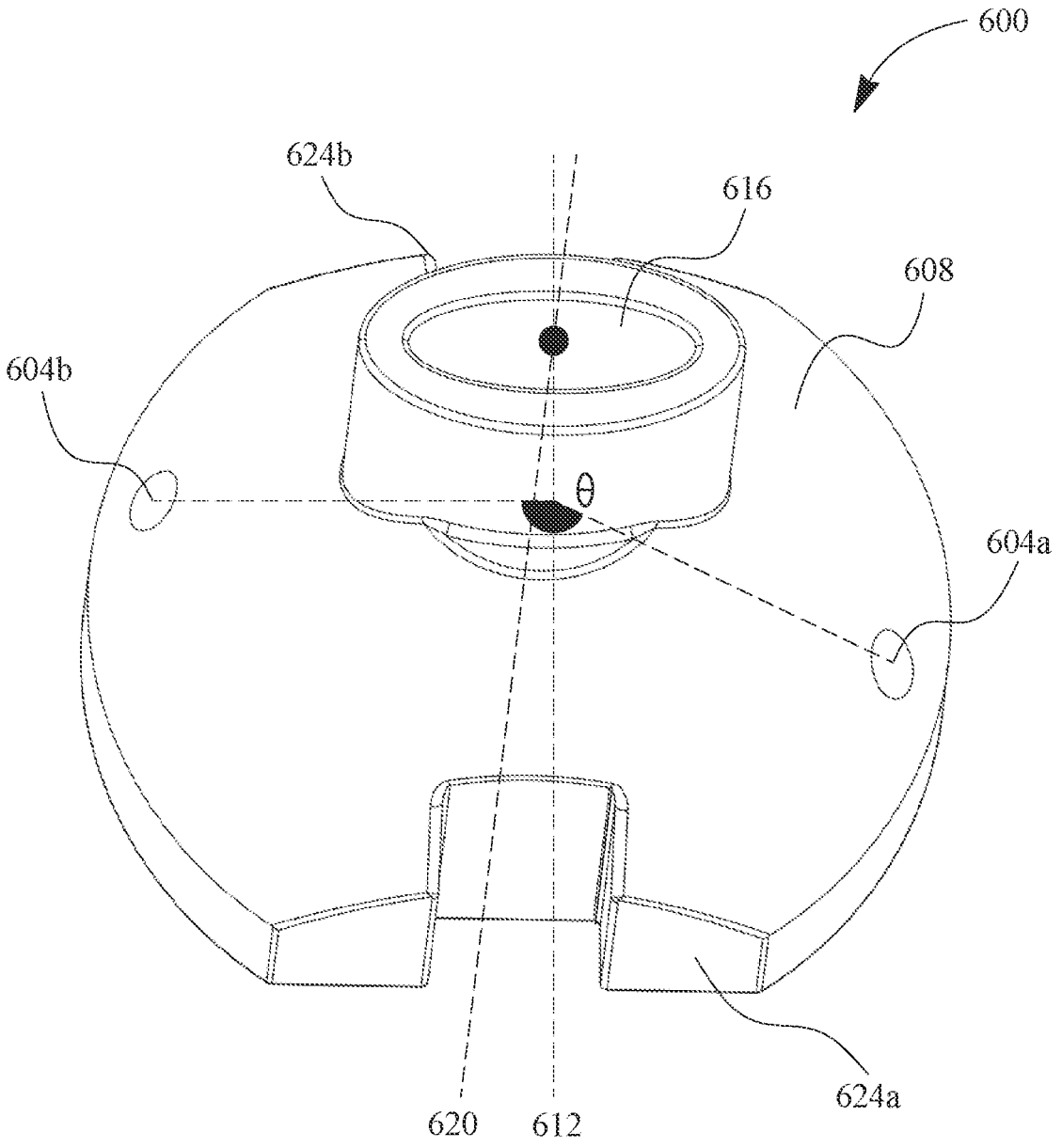
FIG. 6 illustrates a perspective view of an exemplary embodiment of an inner mouthpiece portion of the mouthpiece assembly.

Now referring to FIG. 6, a perspective view of an exemplary embodiment of an inner mouthpiece portion 600 is illustrated. Inner mouthpiece portion 600 may include a first intake portion 604*a* and a second intake portion 604*b* distributed on an outer surface 608 of inner mouthpiece portion in a symmetrical arrangement. As a non-limiting example, first intake portion 604*a* and second intake portion 604*b* may be equidistantly spaced around a central axis 612 of exhaust portion 616. If inner mouthpiece portion 600 is rotated around the central axis 612 by angle θ, the position of first intake portion 604*a* may be coincide with the position of second intake portion 604*b* (i.e., rotationally symmetrical arrangement). In case of more than two intake portions, for instances, and without limitation, four intake portions, each intake portion may be separated by a 90 degrees rotation. Additionally, or alternatively, symmetrical arrangement as described here may also include a reflectional symmetrical arrangement, wherein first intake portion 604*a* and second intake portion 604 may be mirrored across a lateral axis 620 that intersects with the central axis 612. It should be noted that the symmetrical arrangement may be also applied to any interface features as described herein (e.g., a first and a second female interface features 624*a*, 624*b* of inner mouthpiece portion 600).

Figure 7:
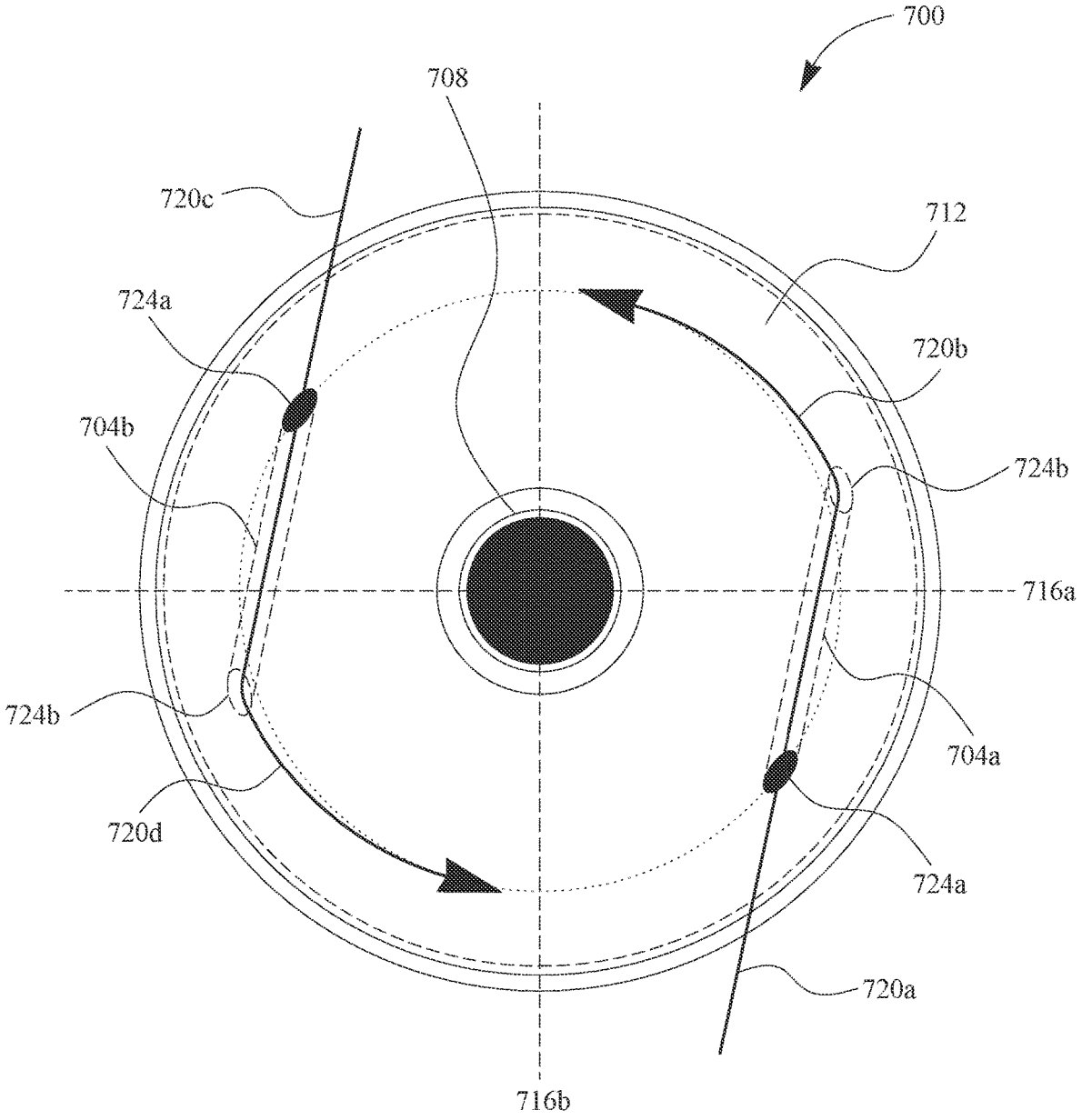
FIG. 7 illustrates a top view of an exemplary embodiment of a mouthpiece assembly.

Now referring to FIG. 7, a top view of an exemplary embodiment of mouthpiece assembly 700 is illustrated. In one or more embodiments, ambient air may flow from external environment through plurality of air inlet channels 704*a-b* of mouthpiece assembly 700, into heating bowl within the body of the atomization device, and out through exhaust passage at outlet portion 708 of mouthpiece assembly 700. Outlet portion 708 may be central positioned on outer surface 712 of outer mouthpiece portion 104. First air inlet channel 704*a* and second air inlet channel 704*b* may be configured as straight conduits angularly positioned relative to a horizontal and vertical central axis 716*a*, 716*b* of mouthpiece assembly 700 across a center of outlet portion 708. As ambient airflow 720*a-d* from external environment enter the device at proximal end 724*a* and exit at distal end 724*b* proximate to heating bowl, it promotes a swirling motion of ambient airflow 720*a-d* as it travels through respective air inlet channel which cools the vapor effectively and efficiently.

With continued reference to FIG. 7, as used in this disclosure, a "swirling motion" is a circular or spiral movement of air and vapor within the chamber or passage. In some cases, swirling motion may be induced by the design of plurality of air inlet channels 704*a-b* as described herein. As a non-limiting example, first air inlet channel 704*a* being angularly offset relative to one another around exhaust passage may be configured to transform a laminar flow 720*a*, 720*c* into turbulent flow 720*b*, 720*d* within exhaust passage or air exchange chamber. In some cases, turbulent flow 720*b*, 720*d* may include a vortex flow. "Laminar flow," for the purpose of this disclosure, is an orderly movement of fluids in which all the particles are moving in parallel layers, with each layer sliding past the adjacent layers without mixing, while the "turbulent flow," for the purpose of this disclosure, is a flow characterized by chaotic changes in pressure and flow velocity, in contrast to laminar flow. As used in this disclosure, "vortex flow" is a flow revolves around an axis (e.g., a center vertical axis of exhaust passage). In some cases, the configuration of generating turbulence within vortex may help improve heat distribution more evenly which leads to more efficient vaporization of material.

With continued reference to FIG. 7, in an embodiment, swirling motion may increase the turbulence of air flow, which may enhance mixing of the air with vaporized substances. In another embodiment, as laminar flow 720*a*, 720*c* swirls, turbulent flow 720*b*, 720*d* may help to cool the vapor by spreading the heat over a larger contact area and increasing the heat exchange rate with the inner surface of inner mouthpiece portion 108 of mouthpiece assembly 700. As a non-limiting example, transforming laminar flow 720*a*, 720*c* into turbulent flow 720*b*, 720*d* (e.g., vortex flow) may include creating an airflow pattern (such as, without limitation, a spiral airflow pattern) that contributes to a dynamic mixing of ambient air from external environment with vapor, thereby increasing vapor production and enhancing a sensory experience of a user upon inhalation. In some cases, such dynamic mixing may include a continual and interactive process that is influenced by the energy imparted to the flow, which may arise from pressure differences within air exchange chamber resulted from the turbulent flow transformation. In some cases, dynamic mixing may ensure a consistent vapor concentration and may improve the flavor profile experience by the user (e.g., uniform, and pleasant taste) via thoroughly mixing vapor with ambient air. Alternatively, in some cases, first air inlet channel 704*a* and second air inlet channel 704*b* may be configured in a curved or helical manner.

With continued reference to FIGS. 7, in some cases, the magnetic connection as described herein may permit mouthpiece assembly 700 to rotate about a horizontal axis relative to the body of the atomizer device. Such rotational freedom afforded by ring-shaped magnet 340 as described above may be utilized to augment the transformation of laminar airflow into vortex flow. In a non-limiting example, as mouthpiece 700 is rotated, for example, manually by a user, it may induce a spiraling motion in the ambient air entering through one or more air inlet channels 704*a-b*, which may contribute to creating a more turbulent and rotational flow pattern. In some cases, the action of rotating the mouthpiece may dynamically alter one or more characteristics of airflow within the atomization device. In a non-limiting example, the laminar flow, characterized by smooth and straight-line airflow, may be disturbed even more by the rotation, leading to an increased interaction between air molecules and the vaporized substance; thus, at least in part, such interaction may promote the formation of a vortex flow, wherein the airflow adopts the spiral airflow pattern as described above, increasing vapor production.

Figure 8:
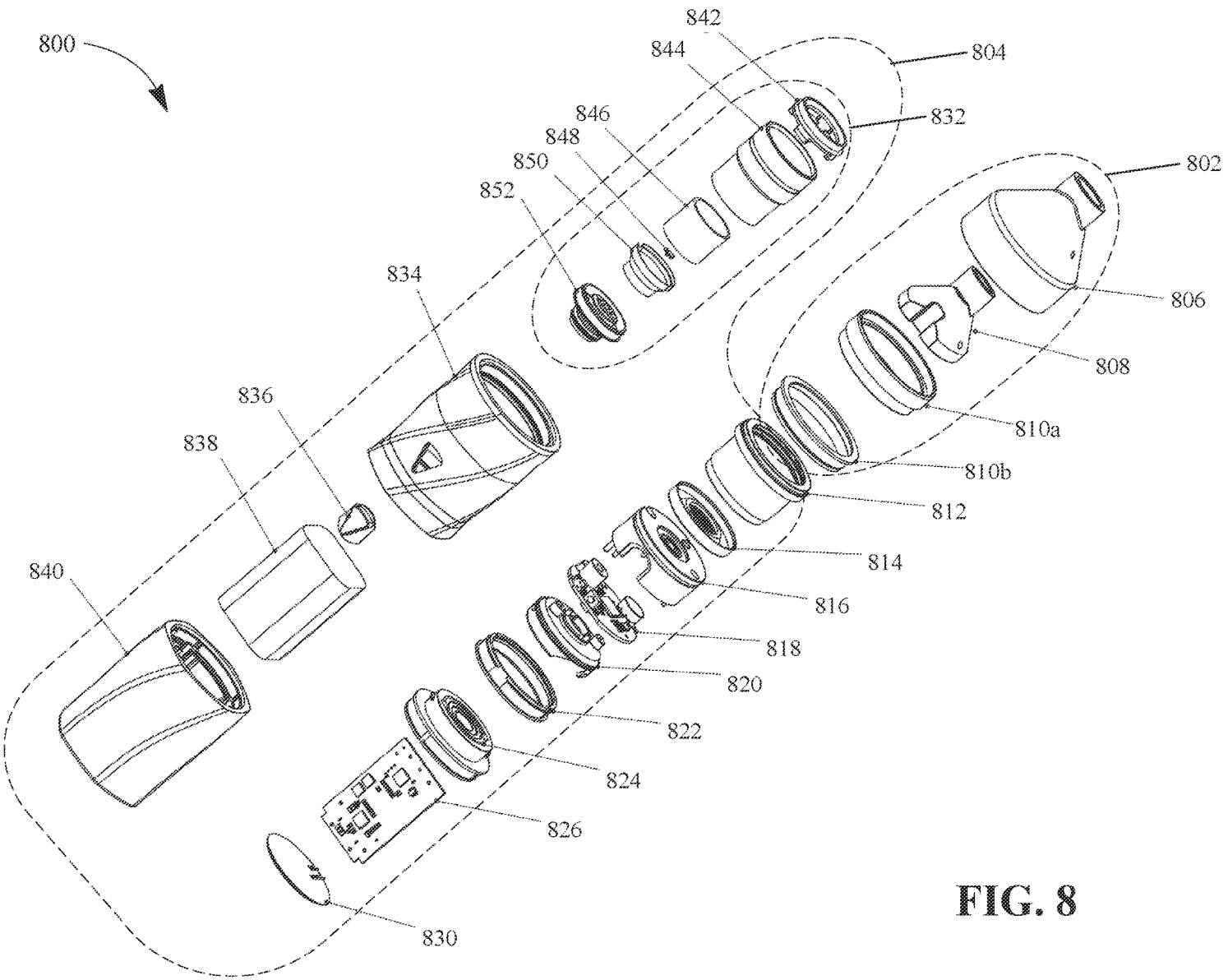
FIG. 8 illustrates an exploded view of an exemplary embodiment of an atomization device.

Now referring to FIG. 8, an exploded view of an exemplary embodiment of an atomization device 800 is illustrated. Atomization device 800 includes a mouthpiece assembly 802 configured to engage a body assembly 804 of atomization device 800. Mouthpiece assembly 802 includes an outer mouthpiece 806, an inner mouthpiece 808, and a removable fixation component 810. In some cases, removable fixation component 810*a* may include a ring-shaped magnet 810*b* operationally connected with body assembly 804. This may be implemented, without limitation, as described above with reference to FIGS. 1-7. Body assembly 804 may further includes a base inner shell 812, a base thread component 814, a printed circuit board (PCB) bracket component 816, a PCB board 818; a snap ring bracket component 820, a snap ring fixation 822, a battery upper holding bracket component 824, a battery PCB board 826, a battery lower holding bracket component (not shown for clarity), a wireless charging coil 830, an atomization assembly 832, an external cover component 834, a button 836, a battery/battery pack 838, and a battery external cover component 840.

With continued reference to FIG. 8, in some cases, PCB board 818 may include a computing device. Exemplary computing device may include, without limitation, any computing device as described in this disclosure, including without limitation a microcontroller, microprocessor, digital signal processor (DSP) and/or system on a chip (SoC) as described in this disclosure. Computing device may include, be included in, and/or communicate with a mobile device such as a mobile telephone or smartphone. PCB board 818 may include a single computing device operating independently, or may include two or more computing device operating in concert, in parallel, sequentially or the like; two or more computing devices may be included together in a single computing device or in two or more computing devices. PCB board 818 may interface or communicate with one or more additional devices as described below in further detail via a network interface device. Network interface device may be utilized for connecting computing device to one or more of a variety of networks, and one or more devices. Examples of a network interface device include, but are not limited to, a network interface card (e.g., a mobile network interface card, a LAN card), a modem, and any combination thereof. Examples of a network include, but are not limited to, a wide area network (e.g., the Internet, an enterprise network), a local area network (e.g., a network associated with an office, a building, a campus or other relatively small geographic space), a telephone network, a data network associated with a telephone/voice provider (e.g., a mobile communications provider data and/or voice network), a direct connection between two computing devices, and any combinations thereof. A network may employ a wired and/or a wireless mode of communication. In general, any network topology may be used. Information (e.g., data, software etc.) may be communicated to and/or from a computer and/or a computing device. PCB board 818 may include but is not limited to, for example, a computing device or cluster of computing devices in a first location and a second computing device or cluster of computing devices in a second location. PCB board 818 may include one or more computing devices dedicated to data storage, security, distribution of traffic for load balancing, and the like. Computing device may distribute one or more computing tasks as described below across a plurality of computing devices of computing device, which may operate in parallel, in series, redundantly, or in any other manner used for distribution of tasks or memory between computing devices. Computing device may be implemented using a "shared nothing" architecture in which data is cached at the worker, in an embodiment, this may enable scalability of system 100 and/or computing device.

With continued reference to FIG. 8, PCB board 818 may be designed and/or configured to perform any method, method step, or sequence of method steps in any embodiment described in this disclosure, in any order and with any degree of repetition. For instance, computing device of PCB board 818 may be configured to perform a single step or sequence repeatedly until a desired or commanded outcome is achieved; repetition of a step or a sequence of steps may be performed iteratively and/or recursively using outputs of previous repetitions as inputs to subsequent repetitions, aggregating inputs and/or outputs of repetitions to produce an aggregate result, reduction or decrement of one or more variables such as global variables, and/or division of a larger processing task into a set of iteratively addressed smaller processing tasks. Computing device of PCB board 818 may perform any step or sequence of steps as described in this disclosure in parallel, such as simultaneously and/or substantially simultaneously performing a step two or more times using two or more parallel threads, processor cores, or the like; division of tasks between parallel threads and/or processes may be performed according to any protocol suitable for division of tasks between iterations. Persons skilled in the art, upon reviewing the entirety of this disclosure, will be aware of various ways in which steps, sequences of steps, processing tasks, and/or data may be subdivided, shared, or otherwise dealt with using iteration, recursion, and/or parallel processing.

With continued reference to FIG. 8, atomization assembly 832 includes a lid 842 (which may be made of various materials including, without limitation, ceramic), an outer shell 844, a heating bowl assembly (that includes a heating bowl 846 and a heating element (not shown for clarity), a temperature sensor 848, a heating bowl connector 850, and a base 852. In some cases, atomization assembly 832 and/or components thereof such as, without limitation, heating element and temperature sensor 848, may be communicatively connected to computing device of PCB board 818 as described above. In some cases, various organic materials may be placed within the heating bowl 846 including, but not limited to, plant material (e.g., botanicals, medicinal herbs, cannabis, etc.), oil (e.g., botanical oils, cannabis oils, etc.), aromatherapy material (e.g., essential oils, botanical oils, etc.) and the like. With further respect to organic materials including cannabis materials, these may include but are not limited to natural herb such as cannabis flower, bud, or kief, as well as hemp; concentrates such as kief, shatter, oil, wax, powder, or rosin; etc. It should be understood that specific chemical compounds of, for purpose of example, cannabis, may be stored or atomized in varying forms having various benefits and limitations, thus the need for atomization devices that provide a variety of temperatures and heat distribution may be dependent upon the intended use for a specific organic material as well as the final substance type such material is concentrated within. For other organic materials, for example aromatherapy materials, the material type may benefit from different solutions including oils, or waxes, and thus the heating elements and heating distribution may be dependent upon the same.

With continued reference to FIG. 8, furthermore, atomization of materials meant for inhalation as compared to materials intended for dispersion in ambient air require different heating elements with respect to temperature levels and heat distribution. Heating bowl 846 may be made of various materials including, without limitation, an inorganic nonmetallic material (e.g., quartz, glass or ceramic). Due to better high-temperature resistance, the material of the heating bowl 236 may not generate peculiar smell during high-temperature heating to mix into the vapor formed by atomizing the organic material, so that the vapor has a higher purity and a better taste. It should be understood that specific chemical compounds of, for purpose of example, cannabis, may be stored or atomized in varying forms having various benefits and limitations, thus the need for a mouthpiece assembly 802 with an exhaust passage having a particular route may be dependent upon the intended use for a specific organic material as well as the final substance type such material is concentrated within.

Figure 9:
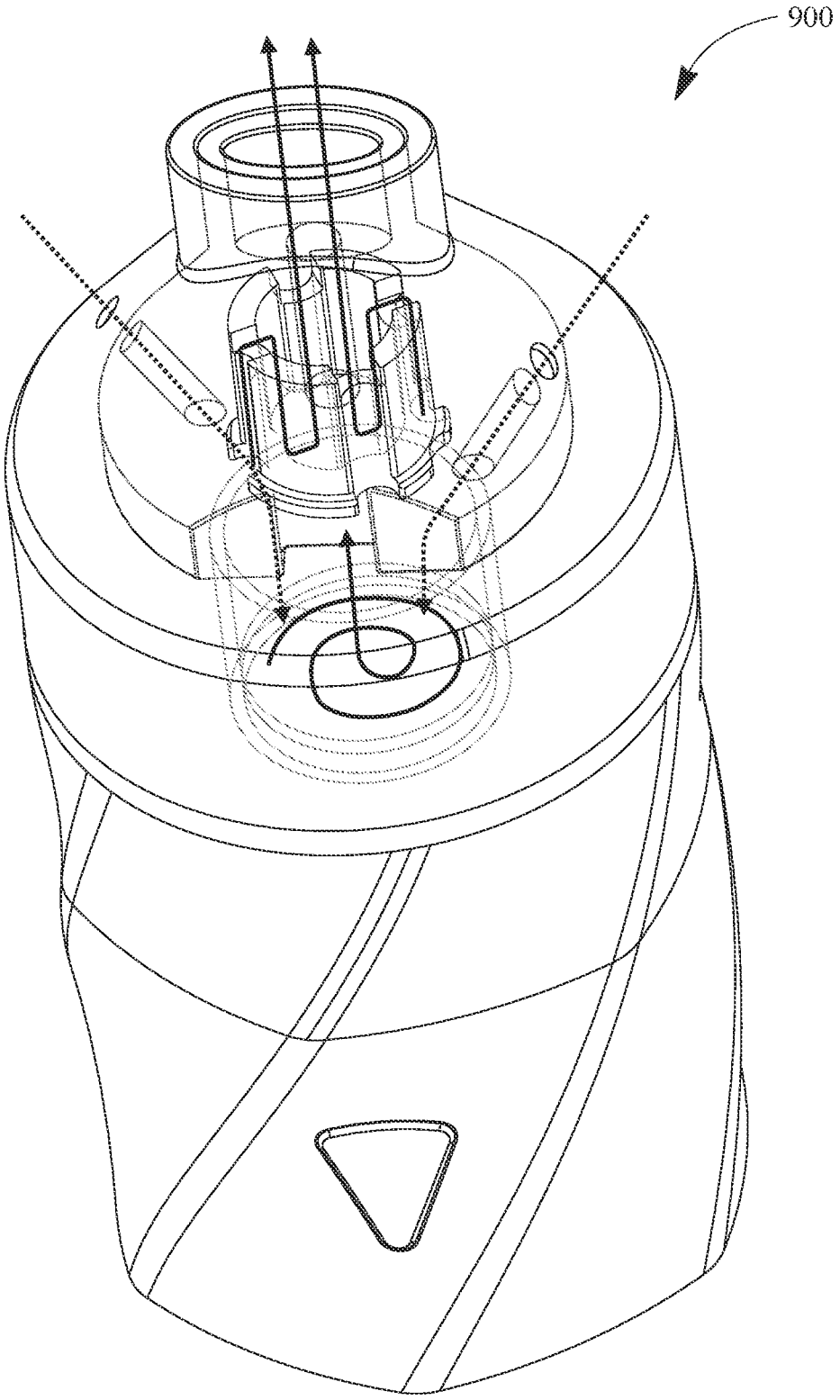
FIGS. 9-11 illustrate perspective views of air pathways inside the exemplary embodiments of a mouthpiece assembly of an atomization device.

Referring now to FIG. 9, an exemplary embodiment 900 of an atomization device in a transparent, perspective view, showcasing the air pathways in relation to the device assembly's structure is illustrated (not labeled for clarity). Solid arrows indicate gas flow out of device, while broken arrow indicates gas flow into device. Broken lines illustrate the internal structure of mouthpiece assembly (i.e., air inlet channels which are the pathways for ambient air to enter device or for vapor to exist device during the user's inhalation). atomization device may include a mouthpiece assembly configured to engage a body assembly of an atomization device, wherein the mouthpiece assembly include an outer mouthpiece portion and an inner mouthpiece portion removably engaged to at least an inner side of the outer mouthpiece portion. Outer mouthpiece portion may include an outlet portion, and a first inlet portion and a second inlet portion distributed on an outer surface of the outer mouthpiece portion in a symmetrical arrangement. Inner mouthpiece portion may include an exhaust portion having a first end in communication with the body of the atomization device and a second end aligned with the outlet portion of the outer mouthpiece portion, wherein the exhaust portion and the outlet portion define an exhaust passage, and a first intake portion and a second intake portion distributed on an outer surface of the inner mouthpiece portion in the symmetrical arrangement, wherein a first and second air inlet channels are defined by an alignment of the first and second inlet portions of the outer mouthpiece portion with the respective first and second intake portions of the inner mouthpiece portion. Each of the first and second air inlet channel may include a proximal end open to an external environment and a distal end in communication with the body of the atomization device, wherein the first and second air inlet channels are angularly offset relative to one another around the exhaust passage.

With continued reference to FIG. 9, in some cases, ambient air may enter from external environment directly into air exchange chamber through first and second air inlet channels. In some cases, first and second air inlet channels being angularly offset relative to one another around exhaust passage may be configured to transform a laminar flow into a vortex flow to create a spiral airflow pattern of a mixture of ambient air and vapor. In some cases, mixture may be drawn from air exchange chamber upon inhalation by the user; flow of mixture may be diverged, by plurality of air outlet channels into a plurality of distributaries (i.e., smaller streams), wherein the plurality of distributaries may be subsequently merged into main flow within the recessed chamber of reservoir insert of inner mouthpiece portion at first end of exhaust portion, pass through the exhaust portion, and then enter into user's mouth at outlet portion of outer mouthpiece portion.

Figure 10:
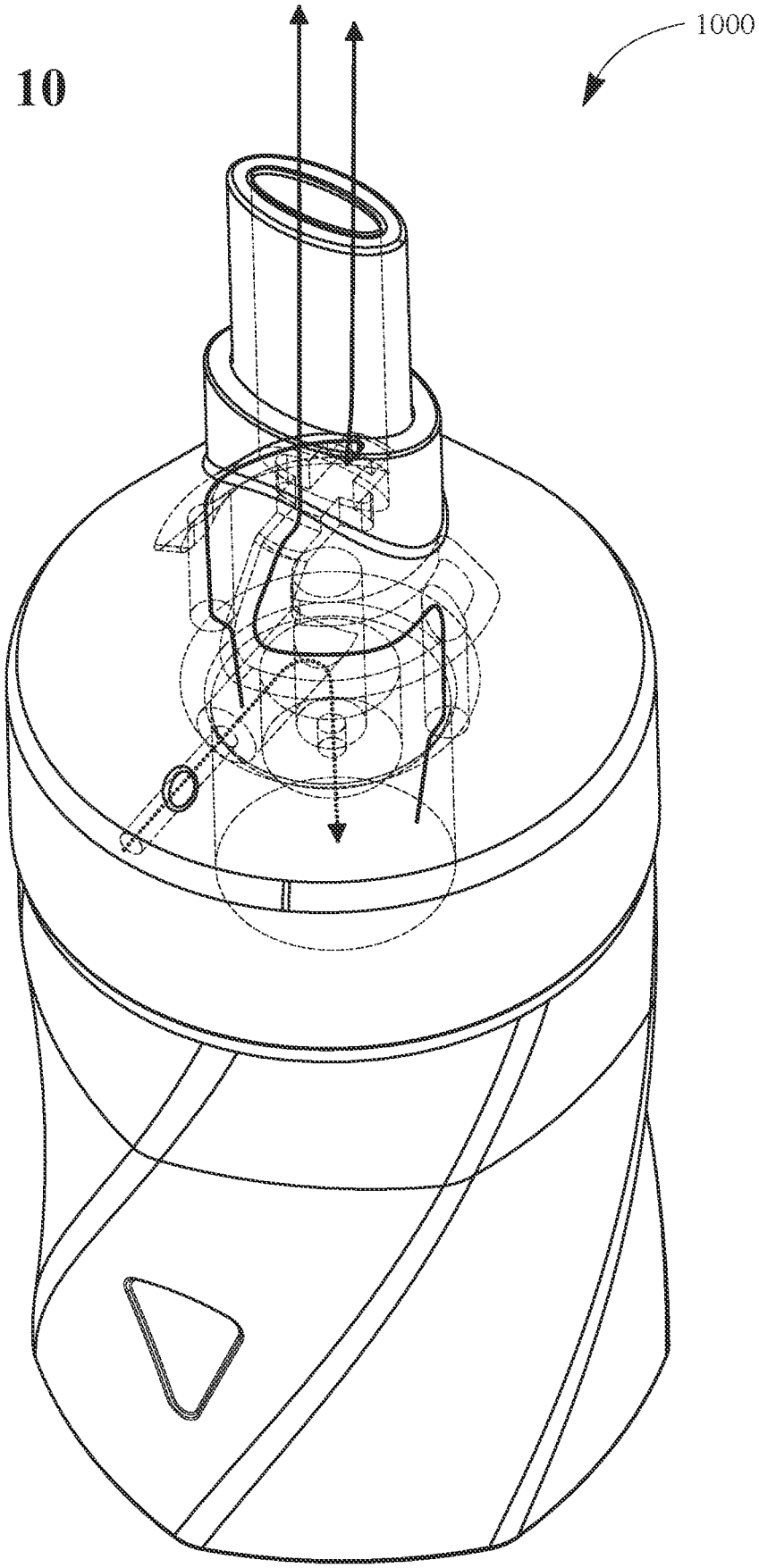
Figure 11:
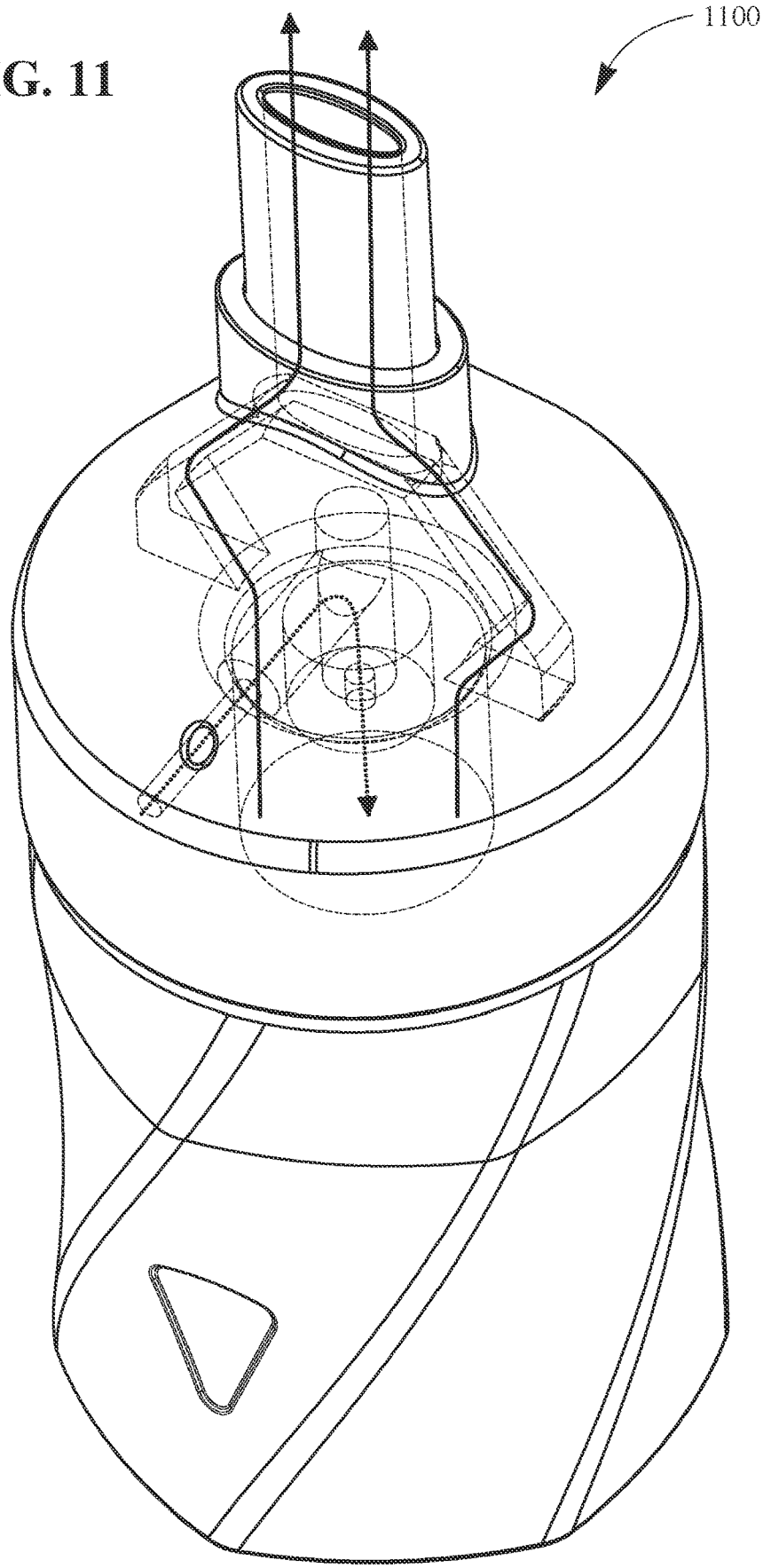

Now referring to FIGS. 10-11, exemplary embodiments 1000, 1100 of an atomization device in transparent, perspective views, both showcasing the air pathways in relation to the device assembly's structure are illustrated (not labeled for clarity). Solid arrows indicate gas flow out of device, while broken arrow indicates gas flow into device. Dash lines illustrate the internal structure of mouthpiece assembly (i.e., air inlet channels which are the pathways for ambient air to enter device or vapor exist device during the user's inhalation). In one or more embodiments, a mouthpiece assembly configured to engage a body of an atomization device, wherein the mouthpiece assembly include an outer mouthpiece portion having an outlet portion and an inlet portion, and an inner mouthpiece portion removably engaged to at least an inner side of the outer mouthpiece portion. Inner mouthpiece portion includes an exhaust portion having a first end in communication with the body of the atomization device and a second end aligned with the outlet portion of the outer mouthpiece portion, wherein the exhaust portion and the outlet portion define an exhaust passage, and an intake portion aligned with the inlet portion of outer mouthpiece portion to form an air inlet channel, wherein the air inlet channel includes a proximal end open to an external environment, and a distal end in communication with the body of the atomization device. This may be implemented, without limitation, as described with reference to FIGS. 1-9. In some cases, distal end of air inlet channel may be orthogonally merged with exhaust passage. As a non-limiting example, as shown in FIGS. 10-11, the point where air inlet channel meets exhaust passage may do so at 90 degrees angle. In some cases, mouthpiece assemblies of atomization devices illustrated in FIGS. 10-11 may omit inner mouthpiece portions.

With continued reference to FIGS. 10-11, in some cases, ambient air may enter the body of atomization device through the air inlet channel and mixed with vapor in the air exchange chamber. When user inhale, the mixture (of air and vapor) may be drawn out of the air exchange chamber through one or more air outlet channels that configured in an elevated configuration, wherein the one or more air outlet channels may elevate trajectory against at least an inner side of inner mouthpiece, creating one or more longer paths for the mixture to travel before exiting the atomization device through outlet portion. In these cases, such extended pathway may aid in further cooling the vapor as it is exposed to relatively cooler surface of inner mouthpiece portion for a longer. Additionally, as the mixture climbs along the one or more air inlet channels may utilize gravity to assist in the condensation of excess moisture, allowing condensed liquid to be collected away from the main airflow. Air outlet channels may merge (at the second end of exhaust portion of inner mouthpiece portion) into a main air outlet channel. In an embodiment, as shown in FIG. 10, air outlet channels may be meandering, for example, and without limitation, each air outlet channel may include a plurality of turns and/or twists. As a non-limiting example, the tail portion of outlet portion may include a star or a cross shaped cross-section, wherein first flow of mixture from a first air outlet channel and second flow of mixture from a second air outlet channel may converge in opposite directions at the tail portion. In some cases, first and second flow of mixture may directly collide, creating a turbulent mixing zone proximate to second end of exhaust portion of inner mouthpiece portion. In another embodiment, as shown in FIG. 11, air outlet channels may be straight.

In addition, the claimed invention is not limited in size and may be constructed in various sizes in which the same or similar principles of operation as described above would apply. Furthermore, the figures (and various components shown therein) of the specification are not to be construed as drawn to scale.

The terminology used herein is for the purpose of describing particular example embodiments only and is not intended to be limiting. Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps. In other words, unless explicitly stated to the contrary, embodiments "comprising" or "having" an element or a plurality of elements having a particular property can include additional elements not having that property. In other words, the terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. In other words, the use of "including," "comprising," "having," "containing," "involving," and variations thereof, is meant to encompass the items listed thereafter and additional items. Further, references to "one embodiment" or "one implementation" are not intended to be interpreted as excluding the existence of additional embodiments or implementations that also incorporate the recited features. The term "exemplary" is intended to mean "an example of".

As used herein, the singular forms "a", "an" and "the" may be intended to include the plural forms as well, unless the context clearly indicates otherwise. In other words, an element or step recited in the singular and preceded by the word "a" or "an" should be understood as not necessarily excluding the plural of the elements or steps. Further, references to "one embodiment" or "one implementation" are not intended to be interpreted as excluding the existence of additional embodiments or implementations that also incorporate the recited features. Thus, when introducing elements of aspects of the disclosure or the examples thereof, the articles "a," "an," "the," and "said" are intended to mean that there are one or more of the elements. In other words, the indefinite articles "a", "an", "the", and "said" as used in the specification and in the claims, unless clearly indicated to the contrary, should be understood to mean "at least one." The use of the expression "at least" or "at least one" suggests the use of one or more elements or ingredients or quantities, as the use may be in the embodiment of the disclosure to achieve one or more of the desired objects or results.

In the description of the present invention, it should be understood that the orientation or position relationship indicated by the terms "up", "down", "front", "rear", "left", "right", "vertical", "horizontal", "top", "bottom", "inside", "outside", and the like is based on the orientation or position relationship shown in the accompanying drawings, it is only for the convenience of description of the present invention and simplification of the description, and it is not to indicate or imply that the indicated device or element must have a specific orientation, and be constructed and operated in a specific orientation. Therefore, the terms shall not be understood as limiting the present invention.

In the description of the present invention, several means one or more, a plurality of means more than two, greater than, less than, more than, and the like are understood as not including this number, while above, below, within, and the like are understood as including this number. If there are the descriptions of first and second, it is only for the purpose of distinguishing technical features, and should not be understood as indicating or implying relative importance, implicitly indicating the number of the indicated technical features or implicitly indicating the order of the indicated technical features.

In the description of the present invention, it should be noted that the terms "installation", "connected" and "connection" if any shall be understood in a broad sense unless otherwise specified and defined. For example, they may be fixed connection, removable connection or integrated connection; may be mechanical connection or electrical connection; and may be direct connection, or indirect connection through an intermediate medium, and connection inside two elements. The specific meanings of the above terms in the present invention can be understood in a specific case by those of ordinary skills in the art.

The numerical values mentioned for the various physical parameters, dimensions or quantities are only approximations and it is envisaged that the values higher/lower than the numerical values assigned to the parameters, dimensions or quantities fall within the scope of the disclosure, unless there is a statement in the specification specific to the contrary.

Any range or value given herein can be extended or altered without losing the effect sought, as will be apparent to the skilled person.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

While various spatial and directional terms, such as "top," "bottom," "upper," "lower," "vertical," and the like are used to describe embodiments and implementations of the present disclosure, it is understood that such terms are merely used with respect to the orientations shown in the drawings. The orientations can be inverted, rotated, or otherwise changed, such that a top side becomes a bottom side if the structure is flipped 180 degrees, becomes a left side or a right side if the structure is pivoted 90°, and the like. In other words, spatially relative terms, such as "front," "rear," "left," "right," "inner," "outer," "beneath", "below", "lower", "above", "upper", "horizontal", "vertical", "lateral", "longitudinal" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below", or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

It will be understood that the benefits and advantages described above can relate to one embodiment or can relate to several embodiments. The embodiments are not limited to those that solve any or all of the stated problems or those that have any or all of the stated benefits and advantages. It will further be understood that reference to 'an' item refers to one or more of those items.

The order of execution or performance of the operations in examples of the disclosure illustrated and described herein is not essential, unless otherwise specified. That is, the operations can be performed in any order, unless otherwise specified, and examples of the disclosure can include additional or fewer operations than those disclosed herein. For example, it is contemplated that executing or performing a particular operation before, contemporaneously with, or after another operation (e.g., different steps, etc.) is within the scope of aspects and implementations of the disclosure. In other words, the method steps, processes, and operations described herein are not to be construed as necessarily requiring their performance in the particular order discussed or illustrated, unless specifically identified as an order of performance. It is also to be understood that additional or alternative steps may be employed.

The phrase "one or more of the following: A, B, and C" means "at least one of A and/or at least one of B and/or at least one of C." The phrase "and/or", as used in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of or "exactly one of," or, when used in the claims, "consisting of," will refer to the inclusion of exactly one element of a number or list of elements. In general, the term "or" as used shall only be interpreted as indicating exclusive alternatives (i.e., "one or the other but not both") when preceded by terms of exclusivity, such as "either," "one of" "only one of" or "exactly one of." "Consisting essentially of," when used in the claims, shall have its ordinary meaning as used in the field of patent law.

As briefly discussed above, as used in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

Use of ordinal terms such as "first," "second," "third," etc., in the claims to modify a claim element does not by itself connote any priority, precedence, or order of one claim element over another or the temporal order in which acts of a method are performed. Ordinal terms are used merely as labels to distinguish one claim element having a certain name from another element having a same name (but for use of the ordinal term), to distinguish the claim elements.

Having described aspects of the disclosure in detail, it will be apparent that modifications and variations are possible without departing from the scope of aspects of the disclosure as defined in the appended claims. As various changes could be made in the above constructions, products, and methods without departing from the scope of aspects of the disclosure, it is intended that all matter contained in the above description and shown in the accompanying drawings shall be interpreted as illustrative and not in a limiting sense.

It is to be understood that the above description is intended to be illustrative, and not restrictive. For example, the above-described embodiments (and/or aspects thereof) can be used in combination with each other. In addition, many modifications can be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are example embodiments. Many other embodiments will be apparent to those of ordinary skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112 (f), unless and until such claim limitations expressly use the phrase "means for" followed by a statement of function void of further structure.

This written description uses examples to disclose the various embodiments of the disclosure, including the best mode, and also to enable any person of ordinary skill in the art to practice the various embodiments of the disclosure, including making and using any devices or systems and performing any incorporated methods. The patentable scope of the various embodiments of the disclosure is defined by the claims, and can include other examples that occur to those persons of ordinary skill in the art. Such other examples are intended to be within the scope of the claims if the examples have structural elements that do not differ from the literal language of the claims, or if the examples include equivalent structural elements with insubstantial differences from the literal language of the claims.

This invention is, however, susceptible to modifications and alternate constructions from that discussed above that are fully equivalent. Moreover, features described in connection with one embodiment of the invention may be used in conjunction with other embodiments, even if not explicitly stated above. Consequently, this invention is not limited to the particular embodiments disclosed. On the contrary, this invention covers all modifications and alternate constructions coming within the spirit and scope of the invention as generally expressed by the following claims, which particularly point out and distinctly claim the subject matter of the invention.

The following claims are thus to be understood to include what is specifically illustrated and described above, what is conceptually equivalent, what can be obviously substituted and also what essentially incorporates the essential idea of the invention. Those skilled in the art will appreciate that various adaptations and modifications of the just-described preferred embodiment can be configured without departing from the scope of the invention. The illustrated embodiment has been set forth only for the purposes of example and that should not be taken as limiting the invention. Therefore, it is to be understood that, within the scope of the appended claims, the invention may be practiced other than as specifically described herein.

Various technical features of the above embodiments may be combined randomly, and in order to simplify the description, possible combinations of various technical features in the above embodiments are not all described. However, as long as the combinations of these technical features have no contradiction, the combinations of these technical features should be considered as falling into the scope recorded by the specification.

Although the embodiments of the present invention have been shown and described, those of ordinary skills in the art may understand that various changes, modifications, substitutions and variations may be made to these embodiments without departing from the principle and purpose of the present invention, and the scope of the present invention is defined by the claims and their equivalents.

What is claimed is:

1. A mouthpiece assembly configured to engage a body of an atomization device, the mouthpiece assembly comprising:

an outer mouthpiece portion, wherein the outer mouthpiece portion comprises:

an outlet portion; and one or more inlet portions distributed on an outer surface of the outer mouthpiece portion; and an inner mouthpiece portion configured to engage at least an inner side of the outer mouthpiece portion, wherein the inner mouthpiece portion comprises:

an exhaust portion having a first end in communication with the body of the atomization device and a second end aligned with the outlet portion of the outer mouthpiece portion, wherein the exhaust portion and the outlet portion define an exhaust passage;

wherein the outer surface of the inner mouthpiece portion comprises a female interface feature having a plurality of recessed grooves, wherein each recessed groove of the plurality of recessed grooves is configured to accommodate a corresponding protrusion of a plurality male interface features on the inner side of the outer mouthpiece portion, wherein a first pair of female-male interface features is larger than a second pair of female-male interface features in dimensionality to provide stability for the mouthpiece assembly; and one or more intake portions distributed on an outer surface of the inner mouthpiece portion, wherein:

each inlet portion of the one or more inlet portions is aligned with each intake portion of the one or more intake portions to form one or more air inlet channels, wherein a first air inlet channel of the one or more air inlet channels positioned at a first direction is angularly offset relative to a second air inlet channel of the one or more air inlet channels position at a second direction, wherein the second direction is different than the first direction, wherein each air inlet channel of the one or more air inlet channels comprises:

a proximal end configured to communicate with an external environment; and a distal end configured to communicate with the body of the atomization device.

2. The mouthpiece assembly of claim 1, wherein at least a portion of the exhaust portion of the inner mouthpiece portion extends into the outlet portion of the outer mouthpiece portion.

3. The mouthpiece assembly of claim 1, wherein the outlet portion of the outer mouthpiece portion comprises a first hollow neck forming an upper portion of the exhaust passage.

4. The mouthpiece assembly of claim 3, wherein the exhaust portion of the inner mouthpiece portion comprises:

a second hollow neck forming a lower portion of the exhaust passage having an intake in communication with an interior of the first hollow neck of the outlet portion of the outer mouthpiece portion, wherein:

the second hollow neck of the exhaust portion of the inner mouthpiece portion extends through the first hollow neck of the outlet portion of the outer mouthpiece portion.

5. The mouthpiece assembly of claim 4, wherein the exhaust passage comprises:

a channel defined by an exterior of the inner mouthpiece portion, with a portion of the exhaust passage defined by the channel, wherein the channel comprises at least one end in communication with an interior of the second hollow neck of the exhaust portion of the inner mouthpiece portion.

6. The mouthpiece assembly of claim 5, wherein the exhaust passage further comprises an air exchange chamber in communication with the channel.

7. The mouthpiece assembly of claim 1, wherein:

the one or more inlet portions and the one or more intake portions are distributed at predetermined intervals on the outer surface of the outer mouthpiece portion and the inner mouthpiece portion respectively; and each of the one or more air inlet channels comprises at least a choke.

8. The mouthpiece assembly of claim 1, wherein the inner mouthpiece portion further comprises:

a reservoir located at a base of the inner mouthpiece portion in alignment with the exhaust passage, proximate to the distal end of each of the one or more air inlet channels, wherein the reservoir comprises:

a plurality of alternating concaved walls forming a recessed chamber; and at least one air outlet channel disposed along the plurality of alternating concaved walls.

9. The mouthpiece assembly of claim 1, wherein the outer mouthpiece portion further comprises a magnet configured to removably attach the mouthpiece assembly to the body of the atomization device.

10. The mouthpiece assembly of claim 1, wherein the inner mouthpiece portion comprises at least a cooling material selected from a group consisting of metal, glass, ceramic, silicon carbide, aluminum nitride, and quartz.

11. The mouthpiece assembly of claim 1, wherein the inner mouthpiece portion comprises a non-reactive coating.

12. The mouthpiece assembly of claim 1, wherein the outer mouthpiece portion comprises a material selected from a group consisting of silicone material, plastic, polymers, composite material, and glass.

13. The mouthpiece assembly of claim 1, wherein ambient air flows from the external environment through the one or more air inlet channels of the mouthpiece assembly, into a heated chamber within the body of the atomization device, and through the exhaust passage of the mouthpiece assembly, wherein the heated chamber is located proximate to the first end of the exhaust portion of the inner mouthpiece portion.

14. A mouthpiece assembly configured to engage a body of an atomization device, the mouthpiece assembly comprising:

an outer mouthpiece portion, wherein the outer mouthpiece portion comprises:

an outlet portion; and a first inlet portion and a second inlet portion distributed on an outer surface of the outer mouthpiece portion in a symmetrical arrangement; and an inner mouthpiece portion configured to engage to at least an inner side of the outer mouthpiece portion, wherein the inner mouthpiece portion comprises:

an exhaust portion having a first end in communication with the body of the atomization device and a second end aligned with the outlet portion of the outer mouthpiece portion, wherein the exhaust portion and the outlet portion define an exhaust passage;

wherein the outer surface of the inner mouthpiece portion comprises a female interface feature having a plurality of recessed grooves, wherein each recessed groove of the plurality of recessed grooves is configured to accommodate a corresponding protrusion of a plurality of male interface features on the inner side of the outer mouthpiece portion, wherein a first pair of female-male interface features is larger than a second pair of female-male interface features in dimensionality to provide stability for the mouthpiece assembly; and a first intake portion and a second intake portion distributed on an outer surface of the inner mouthpiece portion in the symmetrical arrangement, wherein:

a first and second air inlet channels are defined by an alignment of the first and second inlet portions of the outer mouthpiece portion with the respective first and second intake portions of the inner mouthpiece portion, wherein a first air inlet channel of one or more air inlet channels positioned at a first direction is angularly offset relative to a second air inlet channel of the one or more air inlet channels position at a second direction, wherein the second direction is different than the first direction, wherein each of the first and second air inlet channel comprises:

a proximal end configured to communicate with an external environment; and a distal end configured to communicate with the body of the atomization device.

15. The mouthpiece assembly of claim 14, wherein the symmetrical arrangement of the first and second inlet portions on the outer surface of the outer mouthpiece portion and the first and second intake portions on the outer surface of the inner mouthpiece portion is characterized by a mirrored configuration with respect to a center of the exhaust passage.

16. The mouthpiece assembly of claim 14, wherein the first and second air inlet channels are angularly offset relative to one another around the exhaust passage, and wherein the angular offset of the first and second air inlet channels relative to one another is set at an angle ranging between 0 to 90 degrees.

17. The mouthpiece assembly of claim 14, wherein the first and second air inlet channels being angularly offset relative to one another around the exhaust passage is configured to:

transform a laminar flow into a turbulent flow within the exhaust passage, wherein transforming the laminar flow into the turbulent flow comprises:

creating an airflow pattern which contributes to a dynamic mixing of ambient air from the external environment with vapor, thereby increasing vapor production.

18. A mouthpiece assembly configured to engage a body of an atomization device, the mouthpiece assembly comprising:

an outer mouthpiece portion having an outlet portion and an inlet portion; and an inner mouthpiece portion configured to engage to at least an inner side of the outer mouthpiece portion, wherein the inner mouthpiece portion comprises:

an exhaust portion having a first end configured to communicate with the body of the atomization device and a second end aligned with the outlet portion of the outer mouthpiece portion, wherein the exhaust portion and the outlet portion define an exhaust passage;

wherein an outer surface of the inner mouthpiece portion comprises a female interface feature having a plurality of recessed grooves, wherein each recessed groove of the plurality of recessed grooves is configured to accommodate a corresponding protrusion of a plurality of male interface features on the inner side of the outer mouthpiece portion, wherein a first pair of female-male interface features is larger than a second pair of female-male interface features in dimensionality to provide stability for the mouthpiece assembly; and an intake portion aligned with the inlet portion of the outer mouthpiece portion to form an air inlet channel wherein a first air inlet channel of one or more air inlet channels positioned at a first direction is angularly offset relative to a second air inlet channel of the one or more air inlet channels position at a second direction, wherein the second direction is different than the first direction, wherein the air inlet channel comprises:

a proximal end configured to communicate with an external environment; and a distal end configured to communicate with the body of the atomization device.

19. The mouthpiece assembly of claim 18, wherein the distal end of the air inlet channel is orthogonally merged with the exhaust passage.

* * * * *